US010348006B2

(12) United States Patent
Reynolds et al.

(10) Patent No.: US 10,348,006 B2
(45) Date of Patent: Jul. 9, 2019

(54) DISTRIBUTION BLOCK AND DIN RAIL RELEASE MECHANISM

(71) Applicant: Hubbell Incorporated, Shelton, CT (US)

(72) Inventors: Troy Reynolds, Derry, NH (US); Armand Montminy, Hooksett, NH (US); Evan Martin, Derry, NH (US); Richard Robicheau, Litchfield, NH (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 16/180,701

(22) Filed: Nov. 5, 2018

(65) Prior Publication Data

US 2019/0074611 A1 Mar. 7, 2019

Related U.S. Application Data

(63) Continuation of application No. 15/614,921, filed on Jun. 6, 2017, now Pat. No. 10,141,664, which is a continuation of application No. 14/713,318, filed on May 15, 2015, now Pat. No. 9,673,543.

(60) Provisional application No. 62/040,675, filed on Aug. 22, 2014, provisional application No. 61/994,407, filed on May 16, 2014.

(51) Int. Cl.

| | |
|---|---|
| ***H01R 13/66*** | (2006.01) |
| ***H01R 9/24*** | (2006.01) |
| ***H01R 9/26*** | (2006.01) |
| ***H01R 13/73*** | (2006.01) |
| ***H01R 43/20*** | (2006.01) |

(52) U.S. Cl.

CPC ..... *H01R 9/2491* (2013.01); *H01R 9/2608* (2013.01); *H01R 13/73* (2013.01); *H01R 43/20* (2013.01); *Y10T 29/49004* (2015.01)

(58) Field of Classification Search

CPC ..... H01R 9/2491; H01R 13/73; H01R 43/20; H01R 13/506; H01R 4/2454

USPC ..... 439/533

See application file for complete search history.

(56) References Cited

U.S. PATENT DOCUMENTS

| | | | | |
|---|---|---|---|---|
| 3,531,759 A | | 9/1970 | Hansen | |
| 3,725,851 A | | 4/1973 | Linn | |
| 4,284,316 A | | 8/1981 | Debaigt | |
| 4,682,839 A | * | 7/1987 | Bryce | H01R 13/506 439/598 |
| 5,032,092 A | | 7/1991 | Linn | |
| 5,123,853 A | * | 6/1992 | Gilbert | H01R 4/2454 439/402 |
| 5,922,990 A | | 7/1999 | Alaerts | |
| 6,041,816 A | | 3/2000 | Hiramatsu et al. | |
| 6,126,478 A | | 10/2000 | Presson | |
| 6,147,304 A | | 11/2000 | Doherty | |

(Continued)

*Primary Examiner* — Jean F Duverne

(74) *Attorney, Agent, or Firm* — Michael Best & Friedrich, LLP

(57) ABSTRACT

An electrical distribution block transfer electrical power from a primary conductor to one or more tap conductors. The distribution block includes a base, a conductor block, first and second sidewalls, and a lid. The conductor block and the first and second sidewalls are connected to the base and the lid is connected to the first and second sidewalls. The conductor block includes one or more apertures for receiving more primary conductors and one or more apertures for receiving tap conductors.

20 Claims, 31 Drawing Sheets

(56) References Cited

U.S. PATENT DOCUMENTS

| | | | | |
|---|---|---|---|---|
| 6,497,592 | B1 | 12/2002 | Beadle | |
| 6,605,776 | B1 | 8/2003 | Laukhuf | |
| 6,814,628 | B2 | 11/2004 | Chadbourne | |
| 6,929,517 | B2 | 8/2005 | Tsai | |
| 7,052,333 | B2 | 5/2006 | Siracki et al. | |
| 7,134,921 | B2 | 11/2006 | Siracki et al. | |
| 7,442,043 | B2 | 10/2008 | Yuan | |
| 7,614,917 | B2 | 11/2009 | Yamaguchi | |
| 7,942,679 | B1 | 5/2011 | Gretz | |
| 8,298,019 | B2 | 10/2012 | Russo | |
| 8,921,694 | B2 * | 12/2014 | Moss | H02G 3/16<br>174/481 |
| 9,673,543 | B2 | 6/2017 | Reynolds | |
| 2005/0233649 | A1 | 10/2005 | Gretz | |
| 2011/0233649 | A1 | 5/2011 | Yeh | |
| 2012/0144728 | A1 | 6/2012 | Bodo | |

* cited by examiner

DISTRIBUTION BLOCK AND DIN RAIL RELEASE MECHANISM

RELATED APPLICATIONS

This application is a continuation of U.S. application Ser. No. 15/614,921, filed Jun. 6, 2017, which is a continuation of U.S. application Ser. No. 14/713,318, filed May 15, 2015, which claims priority to U.S. Provisional Applications Ser. Nos. 61/994,407, filed May 16, 2014, and 62/040,675, filed Aug. 22, 2014, the disclosures of which are incorporated herein by reference in their entirety.

FIELD

Various exemplary embodiments relate to electrical power distribution blocks.

BACKGROUND

Electrical power distribution blocks are used to connect two or more electrical conductors in a variety of environments. Distribution blocks are used to transfer power from primary conductors to secondary tap conductors of different sizes. The end of a primary conductor is stripped of insulation and inserted into a first port of a conductor block. The ends of one or more secondary tap conductors are similarly stripped of insulation and inserted into separate, respective tap ports. Electricity is transferred from the primary conductor to the secondary tap conductors through the electrically conductive conductor block.

SUMMARY

According to an exemplary embodiment, an electrical distribution block includes a base having a first base mating feature and a second base mating feature. A conductor block is connected to the base. A first sidewall having a first sidewall mating feature engages the second base mating feature. A second sidewall having a second sidewall mating feature engages the first base mating feature. A lid is connected to the first and second sidewalls.

According to an exemplary embodiment, an electrical distribution block includes a base having a support connecting feature for releasably connecting the base to a support. A conductor block is connected to the base. A first sidewall and a second sidewall are connected to the base. A lid is connected to the first and second sidewalls.

Another exemplary embodiment is directed to a method of assembling an electrical distribution block. A base is provided having a base mating feature. A sidewall having a sidewall mating feature is connected to the base mating feature. A first lid is provided having a first lid connecting feature. A second lid is provided having a second lid connecting feature. One of the first lid or the second lid is selectively connected to the sidewall.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
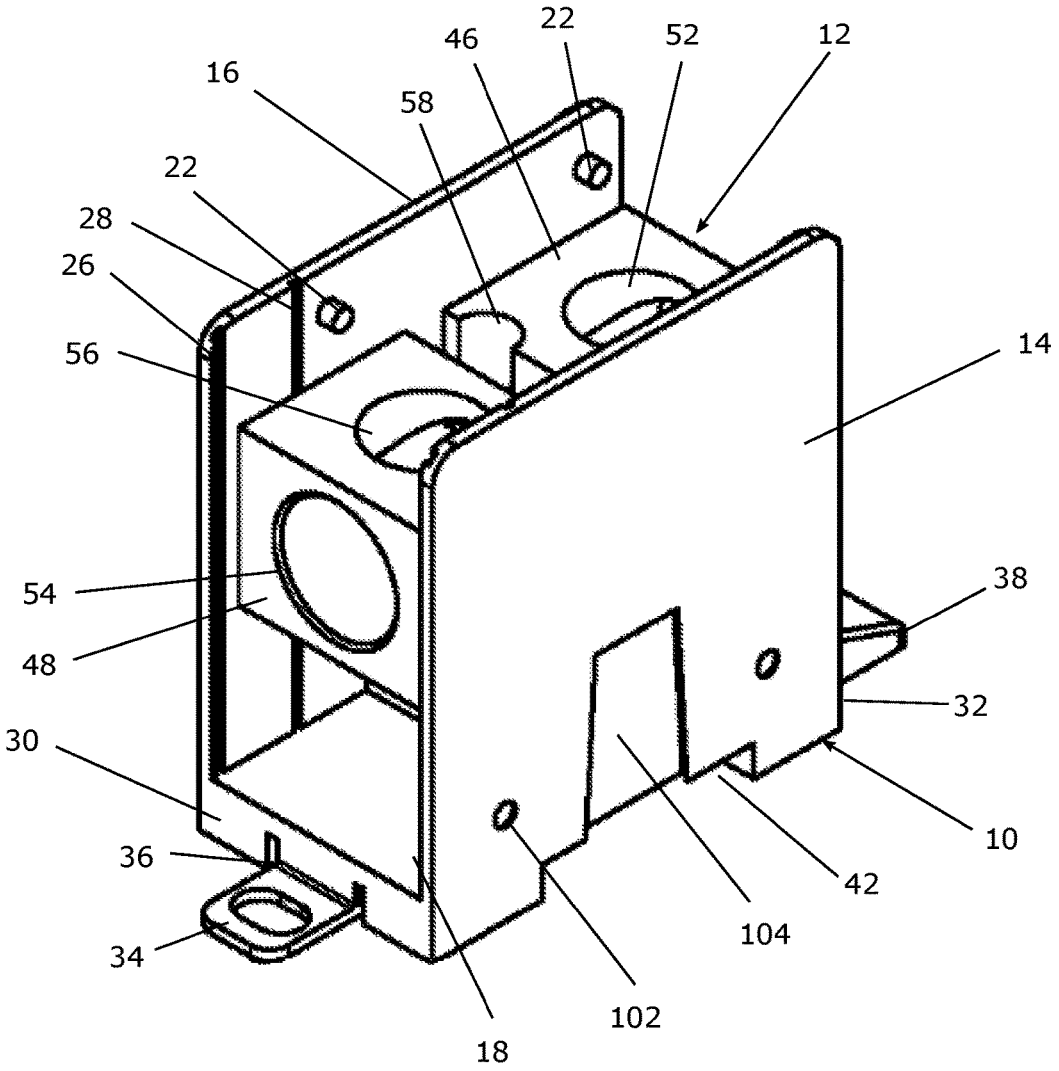
FIG. 1 is a top perspective view of an exemplary distribution block.
Figure 2:
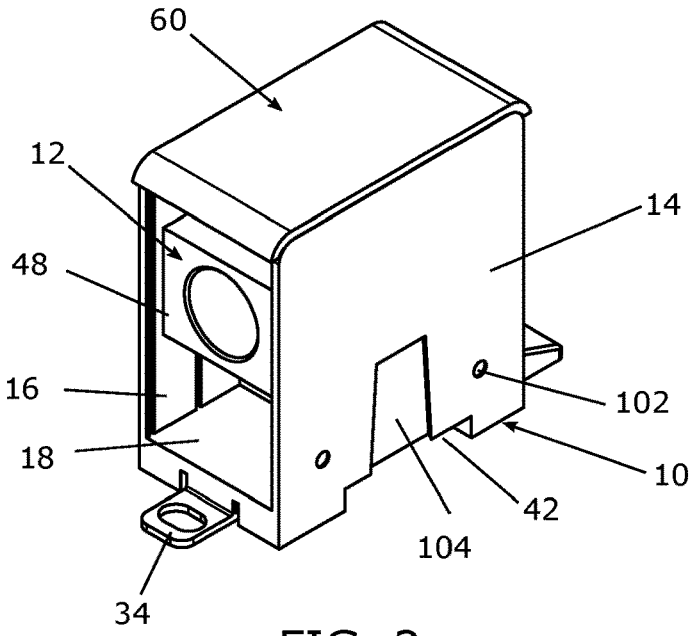
FIG. 2 is a top perspective view of the distribution block of FIG. 1 with a first exemplary lid.

In accordance with an exemplary embodiment, a distribution block assembly includes a base 10 and a conductor block 12. The base 10 includes a first sidewall 14, a second sidewall 16, and a bottom 18 surrounding an interior. A pedestal 20 extends from the bottom 18 to support the conductor block 12. The conductor block 12 receives, and electrically connects, a primary conductor (not shown) and one or more tap conductors (now shown). In various exemplary embodiments, the base 10 is made from a plastic or other polymer material and is molded as a unitary structure. Other suitable materials and methods of manufacturing the base 10 may be used. For example, the base 10 may be made from a ceramic, metal, elastomer, or composite material depending on the application. The base 10 may also be formed from separate components that are connected together. In certain embodiments, the base 10 is made from a non-conductive material so that it can be handled by a user when a live connection is made to the conductor block 12.

In various exemplary embodiments, the first and second sidewalls 14, 16 include one or more lid mounting features for attaching a variety of lids to the base 10. The first sidewall 14 has a first interior surface and a first exterior surface. The second sidewall 16 has a second interior surface and a second exterior surface. The first and second sidewalls 14, 16 include at least one lid mounting feature to enable a connection to a lid or other cover. The lid mounting feature is capable of and configured to receive more than one type of lid. In various exemplary embodiments, the lid mounting feature releasably secures the lid to the base 10, allowing a user to change the lid on a given base 10 as needed.

In the illustrated exemplary embodiment, the lid mounting feature includes one or more protrusions 22 extending from the first and second interior surfaces. For example, a front set of protrusions 22 and a rear set of protrusions 22, with a first front protrusion 22 and a first rear protrusion 22 extending from the interior surface of the first sidewall 14 and a second front protrusion 22 and a second rear protrusion 22 extending from the interior surface of the second sidewall 16. The first and second front protrusions 22 and the first and second rear protrusions 22 substantially align with one another. The protrusions 22 are substantially cylindrical in shape, although other shapes may be used as appropriate to the design of the distribution block assembly. In various exemplary embodiments, different types, sizes, and shapes of lid mounting features may be associated with the first and second sidewalls 14, 16. For example slots or depressions may be formed in the first and second sidewalls 14, 16 or a combination of slots or depressions and protrusions may be used. The placement of the lid mounting features may also be varied.

As best shown in FIG. 1, the first and second sidewalls 14, 16 also include two pairs of aligned slots 26, 28 for receiving a lid or cover. A front slot 26 and a rear slot 28 are positioned on both the first and second sidewalls 14, 16 to receive different covers depending on the desired configuration of the distribution block.

Figure 5:
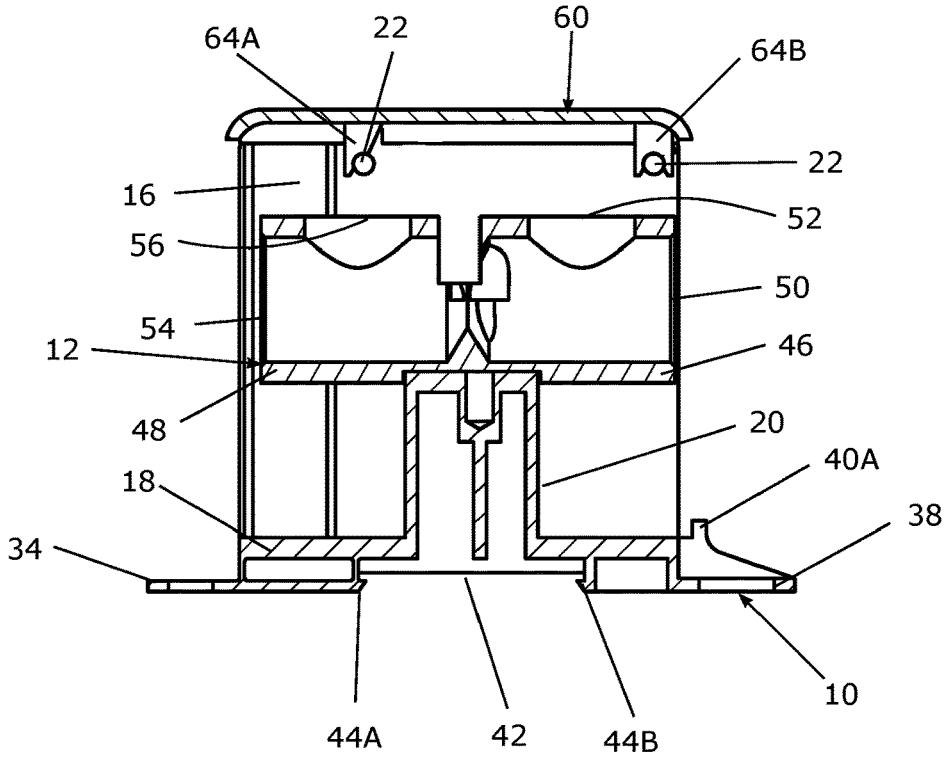
FIG. 5 is a side elevational view in section taken along line 5-5 of FIG. 4.
Figure 6:
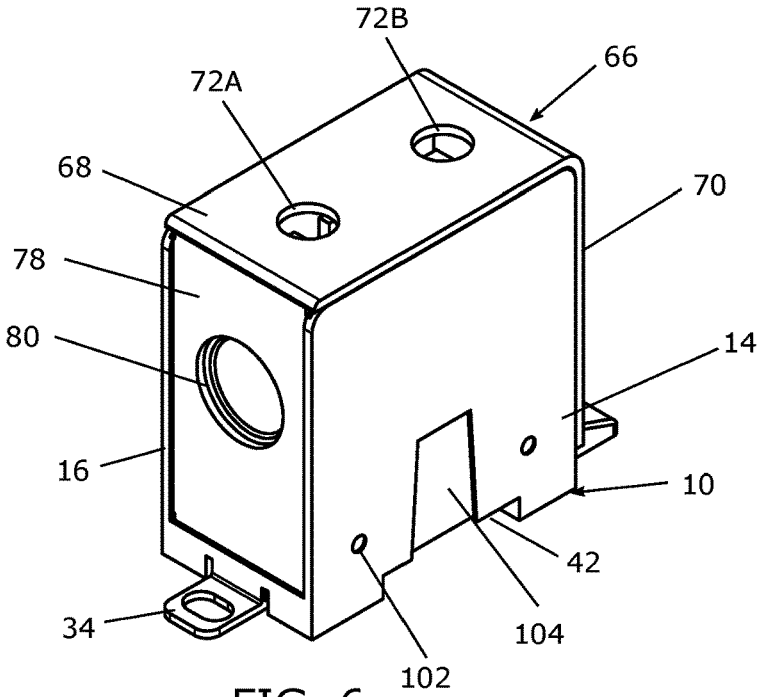
FIG. 6 is a top perspective view of the distribution block of FIG. 1 with a second exemplary lid and cover.
Figure 7:
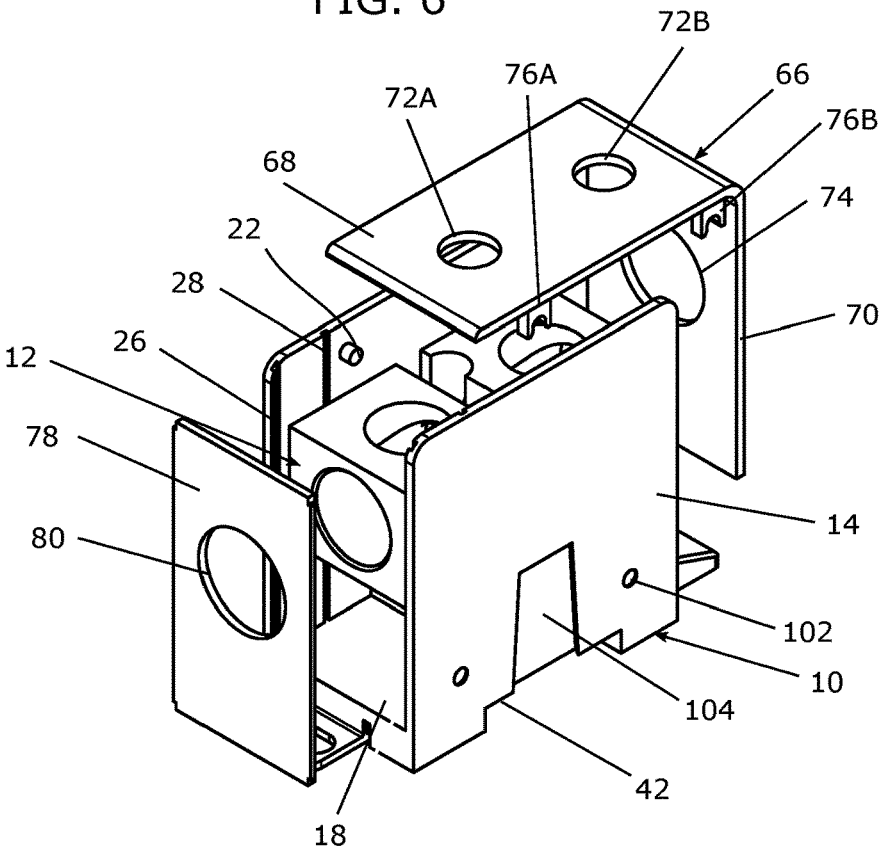
FIG. 7 is a top perspective, exploded view of the distribution block, lid, and cover of FIG. 6.
Figure 8:
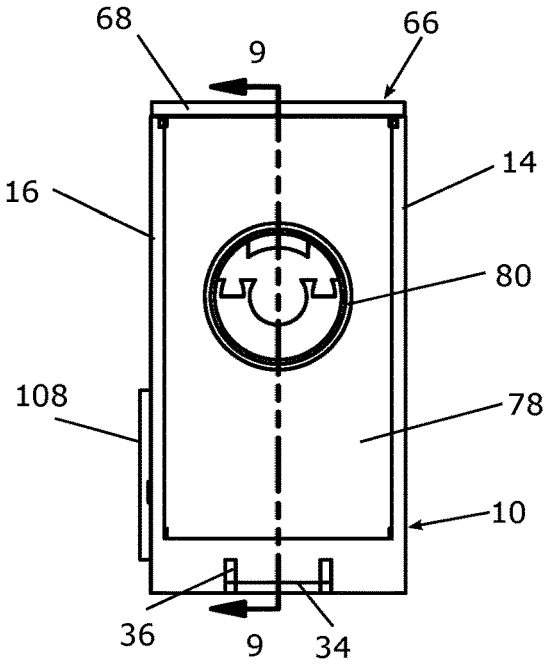
FIG. 8 is a front view of the distribution block, lid, and cover of FIG. 6.
Figure 9:
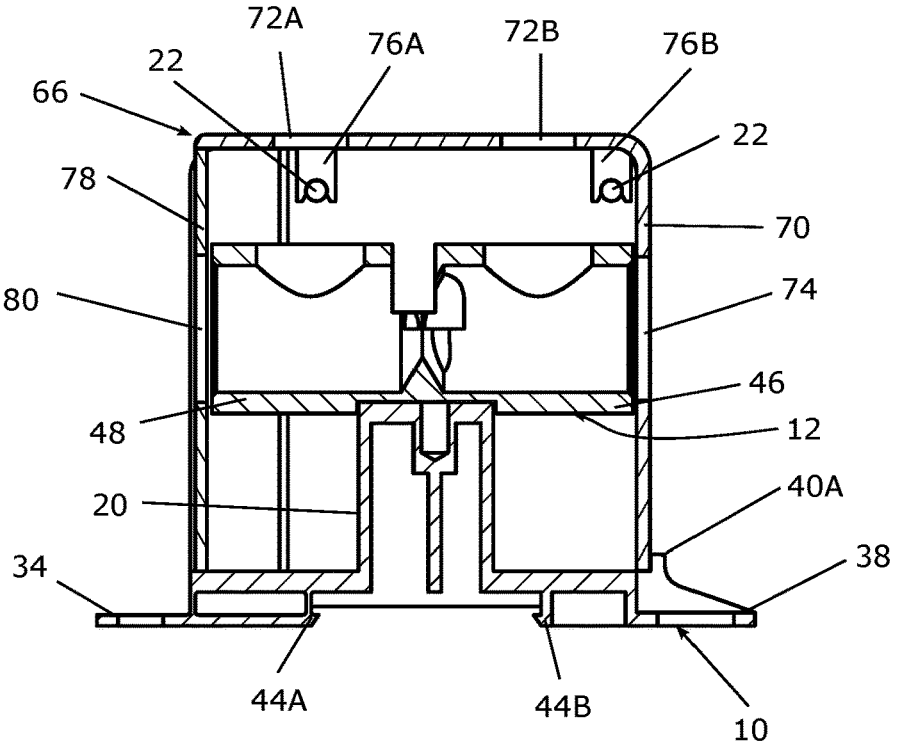
FIG. 9 is a sectional view taken along line 9-9 of the distribution block, lid, and cover of FIG. 8.
Figure 10:
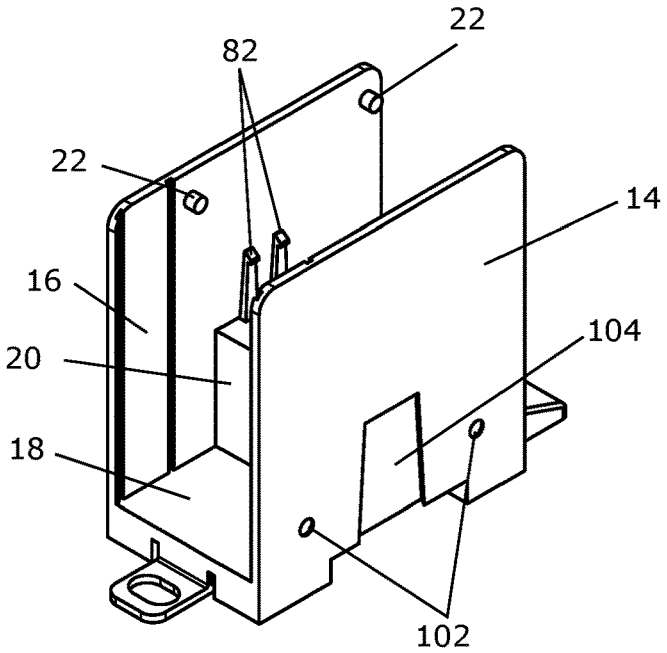
FIG. 10 is a top perspective view of the distribution block of FIG. 1 with a first exemplary block mounting feature.
Figure 11:
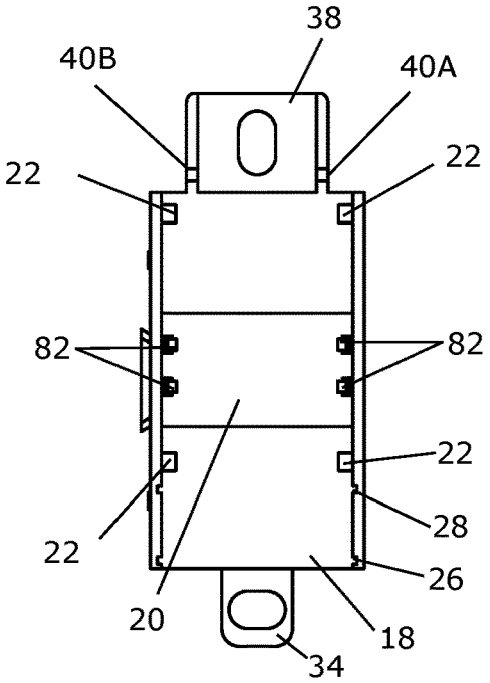
FIG. 11 is a top view of the distribution block of FIG. 10.

The bottom 18 includes a front edge 30 and a rear edge 32. A tab 34 extends from the front edge 30 of the base 10 and has a first opening. The tab 34 may be integrally molded with the base to include one or more flexure areas 36, permitting the tab 34 to be flexed with respect to the base 10. As best shown in FIG. 5, a foot 38 extends from the rear edge 32 of the base 10 and has a second opening and a curved upper surface. One or more posts 40 extend from the top of the curved upper surface, for example, a first post 40A and a second post 40B. The first and second openings are substantially obround in shape with the first opening extending in a first direction and the second opening extending in a second direction orthogonal to the first direction. The first and second openings assist a user in attaching the base to a structure in different orientations using a mechanical fastener (not shown). For example, in the vertical orientation a fastener rests in the center of the second opening and need only be centered by a user in the first opening.

The bottom 18 also includes a channel 42 for attaching the base 10 to a structure, for example a DIN rail. The base 10 may be angled, slid, or snap-fitted to the DIN rail based on the configuration of the channel 42. As best shown in FIG. 5, the channel 42 may be bordered by a first prong 44A and a second prong 44B. The first and second prongs have an angled front surface to simplify mounting the base to the DIN rail. The prongs 44A, 44B may be moved or flexed by a user to remove the base 10 from the DIN rail.

The pedestal 20 extends from the bottom 18 of the base 10 to support the conductor block 12. The conductor block 12 includes a primary block 46 and a tap block 48. The primary and tap blocks 46, 48 have a substantially rectangular cube outer shape and a hollow interior, although other curvilinear or rectilinear shapes may be used. The interior receives and seats the primary and tap conductors. The hollow interior can have a cylindrical shape to match a conductor or other shape. The conductor block 12 is made from a conductive material, for example a metal such as aluminum or copper. In various exemplary embodiments, the conductor block 12 is machined from a single piece of material to have a unitary structure, although multiple pieces may be used and connected together. Conductor blocks having various combinations and configurations of primary blocks 46 and tap blocks 48 may be used as would be understood by one of ordinary skill in the art when viewing this disclosure.

In the exemplary embodiments of FIGS. 1-9, the primary block 46 includes a rear aperture 50 for receiving a primary electrical conductor. The rear aperture 50 is substantially circular in shape, although the size and shape of the rear aperture 50 may vary depending on the conductor. The primary block 46 also includes a top aperture 52 having a thread for receiving a fastener, for example a set screw (not shown). The set screw extends into the hollow interior. When a primary conductor is inserted into the primary block 46, the set screw can be tightened to extend into the hollow interior and contact the primary conductor, retaining the primary conductor in place.

The tap block 48 is electrically connected to the primary block 46. As best shown in FIG. 5, a wall at least partially separates the primary block 46 and the tap block 48. The wall can be closed or a tapered opening may extend through the wall. The tapered opening may be a result of machining tolerances when forming the conductor block. The tap block 48 includes at least one front aperture 54 for receiving a tap electrical conductor. More than one front aperture 54 may be provided to electrically connect multiple tap conductors to a single primary conductor. The front aperture 54 is substantially circular in shape, although the size and shape of the front aperture 54 may vary depending on different conductors. The tap block 48 also includes a top aperture 56 having a thread for receiving a fastener, for example a set screw. The set screw extends into the hollow interior. When a tap conductor is inserted into the tap block 48, the set screw can be tightened to extend into the hollow interior and contact the tap conductor, retaining the tap conductor in place. A groove 58 extends into the top of the primary block 46 that allows a user to view the primary conductor to ensure it is seated properly in the hollow cavity.

Figure 3:
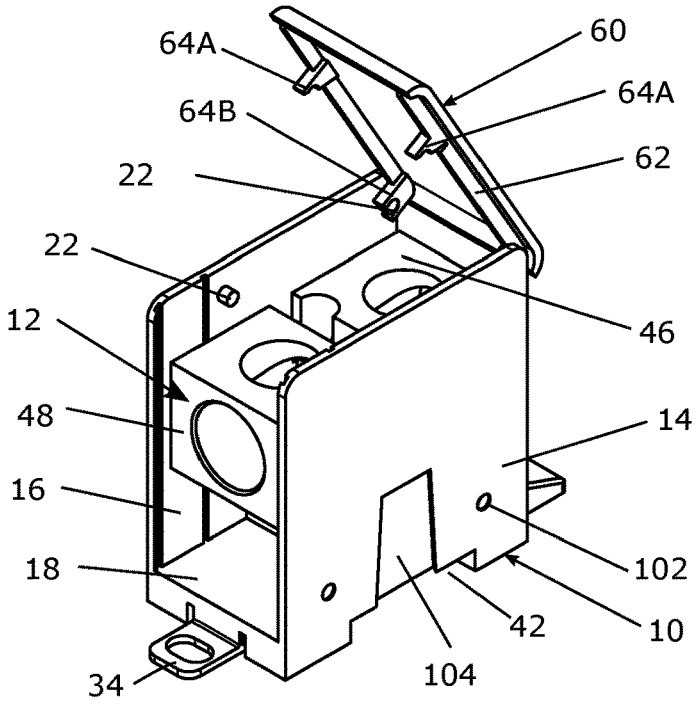
FIG. 3 is a top perspective view of the distribution block and lid of FIG. 2 with the lid in the open position.
Figure 4:
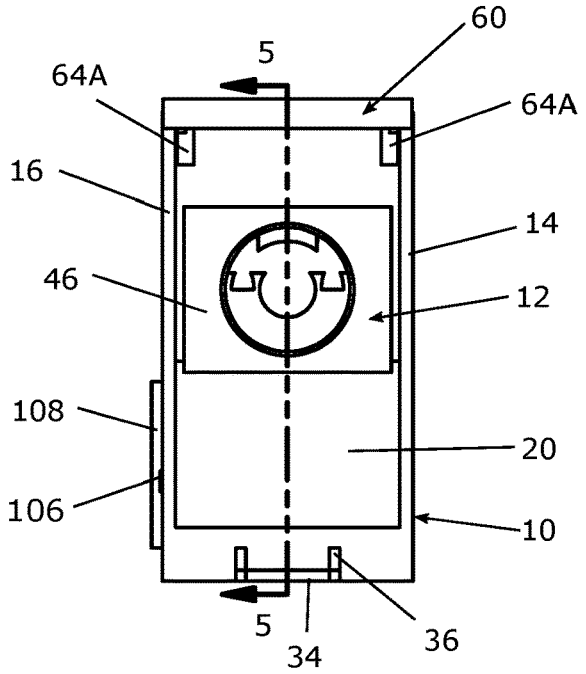
FIG. 4 is a front view of the distribution block and lid of FIG. 2.

FIGS. 2-5 illustrate an exemplary first lid 60 connected to the base. The first lid includes a top surface and a bottom surface. The top surface has a curved front end and a curved back end, although neither end or only one end may be curved. A flange 62 and one or more lid connecting features extend from the bottom surface. The lid connecting features may extend from the bottom surface or the flange, and connect the lid 60 to the base 10 through a mating relationship with the lid mounting features. In an exemplary embodiment, the first lid 60 is molded from a translucent, polymer material. In other alternative embodiments, the first lid 60 is made from other suitable materials such as metal, plastic, or composite materials and has any level of opacity. FIGS. 3 and 5, best show exemplary lid connecting features that include first and second front lid connecting features 64A and first and second rear lid connecting features 64B. The first and second rear lid connecting features 64B have an opening for mating with the rear protrusions 22 of the base 10. The opening may be substantially U-shaped or a half circle. The openings allow the rear lid connecting features 64B to snap-connect to the rear projections 22 and pivotally connect the first lid 60 to the base 10. The front lid connecting features 64A include a curved or arcuate surface, for example a quarter circle, for mating with the front projections 22 of the base 10. The curved surface extends partially around the projection to provide a partial snap connection that assists in retaining the lid 60 in the closed position but allows a user to open the lid 60 as needed.

FIGS. 6-9 illustrate an exemplary second lid 66 connected to the base 10. The second lid 66 includes a first section 68 extending along a top edge of the first and second sidewalls 14, 16 substantially the length of the base 10 and a second section 70 extending from the first section 68 towards the bottom 18 along a back edge of the first and second sidewalls 14, 16. The second section 70 extends at substantially a right angle to the first section 68 or the second section 70 may be obliquely angled to the first section 68. A curved edge connects the first section 68 to the second section 70 although various types of edges may be used.

In various exemplary embodiments, the first section 68 is a top section having a top surface and a bottom surface. The top section extends along substantially the entire length of the first and second sidewalls 14, 16 and has a front edge that may be planar, curved, or chamfered as desired. A first aperture 72A and a second aperture 72B extend through the first section 68. The first and second apertures 72A, 72B provide access to the set screws in the primary block 46 top aperture 52 and the tap block 48 top aperture 56. In various exemplary embodiments, the first and second apertures 72A, 72B are finger-safe apertures sized to allow a tool or driver to be inserted through the second lid 66 but prevent a user's finger from being placed through the second lid 66 and in contact with the conductor block 12.

In various exemplary embodiments, the second section 70 is a rear section having an exterior surface and an interior surface. The second section 70 extends substantially between the first and second sidewalls 14, 16 and along substantially the entire height of the first and second sidewalls 14, 16. A bottom edge of the second section 70 fits into a groove formed by the posts 40A, 40B on the foot 38 extending from the rear surface of the bottom 18. An aperture 74 extends through the second section 70 to provide access for a primary conductor to the primary block 46.

The second lid 66 includes lid connecting features extending from a bottom surface. The lid connecting features connect the lid 66 to the base 10 by a mating relationship with the base mounting features. In the illustrated exemplary embodiment, the lid connecting features include first and second front lid connecting features 76A and first and second rear lid connecting features 76B. The front and rear lid connecting features 76A, 76B have a downwardly facing opening for mating with the front and rear protrusions 22, respectively, of the base 10. For example with a snap fit connection. The openings may be substantially U-shaped or a half circle. The connection helps retain the second lid 66 to the base 10 to prevent accidental contact with the conductor block 12 during use. In an exemplary embodiment, the second lid 66 is molded from a translucent, polymer material. In other alternative embodiments, the second lid 66 is made from other suitable materials such as metal, plastic, or composite materials and has any level of opacity.

In various exemplary embodiments, the second lid 66 is used in connection with a front cover 78 to further enclose the conductor block 12. The front cover 78 is substantially planar and is configured to slide into the front slot 26. When inserted into the front slot 26, the bottom edge of the front cover 78 rests on the bottom 18. When the second lid 66 is connected to the base 10, a top edge of the front cover 78 is adjacent to or in contact with the bottom surface of the first section 68 of the second lid 66. The front cover 78 includes one or more apertures 80 to provide access for tap conductors to the tap block 48. In various alternative embodiments, the tap block 48 receives multiple tap conductors, having a first tier with one or more openings and a second tier positioned above the first tier with one or more openings (not shown). The first and second tiers may be offset in a stair-like configuration. Accordingly, the front cover may be adapted to have a corresponding configuration with a first portion that is received in the first slot 26 and a second portion that is received in the second slot 28. More than one front cover may also be used, for example with one positioned in each slot.

In various exemplary embodiments and configurations, the first lid 60 has an open configuration meeting standards set by the National Electrical Manufactures Association (NEMA) and the Electrical Equipment Manufacturers Association of Canada (EEMAC) and the second lid 66 has a Finger-Safe configuration meeting the standards of the International Electrotechnical Commission (IEC). The base 10 is therefore capable of and configured selectively to connect with one or more types of lids. The first and second lids 60, 66, and other lid configurations may be connected and removed from a common base 10 by a manufacturer or end user as desired. This allows one type of base to be used with greater flexibility, reducing the cost of materials manufacturing, assembly, and inventory. The mounting features for the first and second lids 60, 66 and other lid configurations may also be modified to connect to the base mounting features, creating a fully modular distribution block.

The pedestal 20 extends from the bottom 18 of the base 10 to support the conductor block 12. The pedestal 20 may be integrally molded with the base 10 or formed separately from the base 10 and connected thereto. The size and shape of the pedestal 20 may vary depending on the configuration of the base 10 and the configuration of the conductor block 12. In various exemplary embodiments, one or more block mounting features extend from the pedestal 20 to engage and retain the conductor block 12. The block mounting feature is capable of and configured to receive more than one type of conductor block 12. In various exemplary embodiments, the block mounting feature releasably secures the conductor block 12 to the base 10, allowing a user to change conductor blocks 12 on a given base 10 as needed. The block mounting feature may be integrally formed with the pedestal 20, for example by molding, or separately formed and connected to the pedestal 20.

Figure 12:
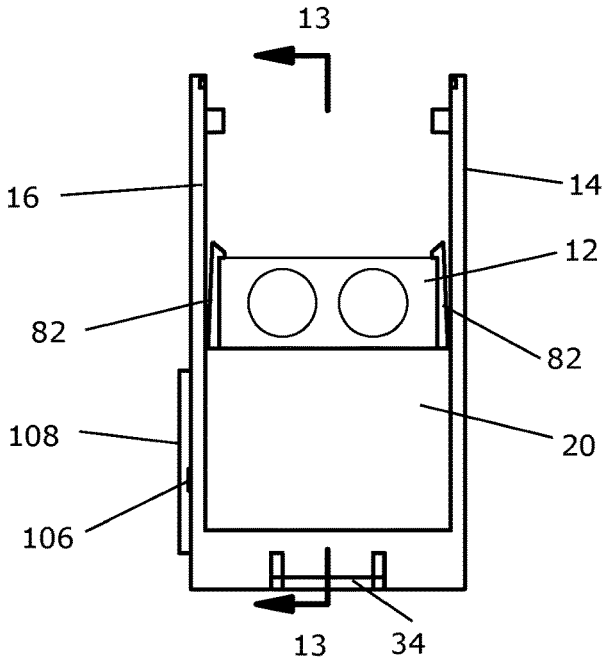
FIG. 12 is a front view of the distribution block of FIG. 10.
Figure 13:
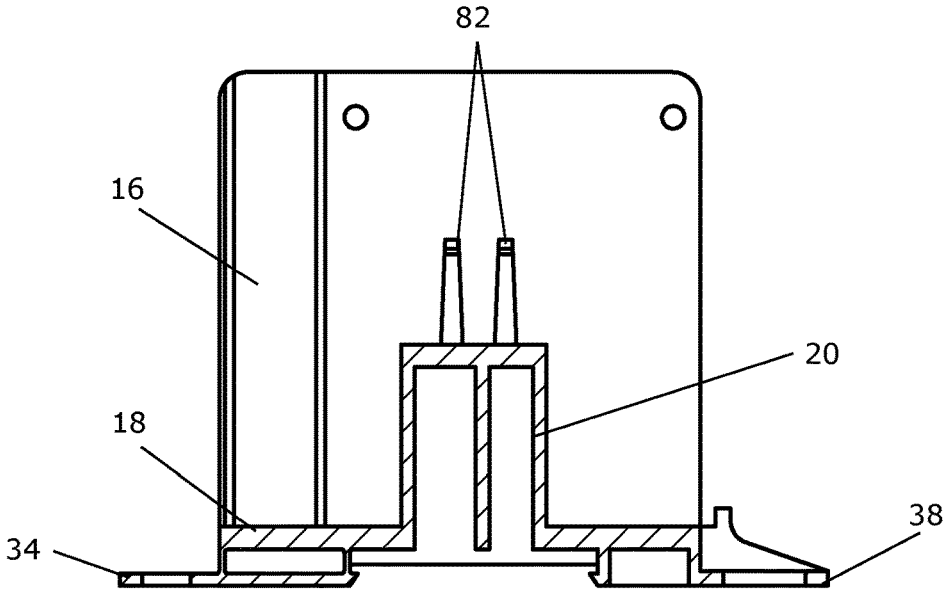
FIG. 13 is a sectional view taken along line 13-13 of the distribution block of FIG. 12.

FIGS. 10-13 illustrate an exemplary embodiment of the block mounting feature having one or more arms 82, for example four arms. Two arms 82 are positioned adjacent the first sidewall 14 and two arms 82 are positioned adjacent the second sidewall 16 and can be integrally formed with the pedestal 20. The number and configuration of the arms 82 may vary, for example, two arms 82 can be used with one arm on each side or one or more arms 82 may be positioned only along a single side. Each arm 82 includes a hook having an angled top wall and a substantially horizontal bottom wall, although different sizes, shapes, and configurations may be used. In exemplary embodiments, the conductor block 12 is snap-fit onto the base 10 and held in place by the arms 82. As best shown in FIG. 12, the arms 82 extend from the pedestal at an angle so that the tops of the arms are spaced from the first and second sidewalls 14, 16. As the conductor block 12 is inserted, the bottom of the conductor block slides along the angled top wall of the hook, flexing the arms against the first and second sidewalls 14, 16. After further insertion, the conductor block 12 clears the top of the hooks and the arms 82 spring back towards their initial position and the bottom surface of the hook retains the conductor block 12 in place. To remove the conductor block 12, the arms 82 may be biased apart, by a user's hand or a tool, enabling the conductor block 12 to be removed from the base 10.

Figure 14:
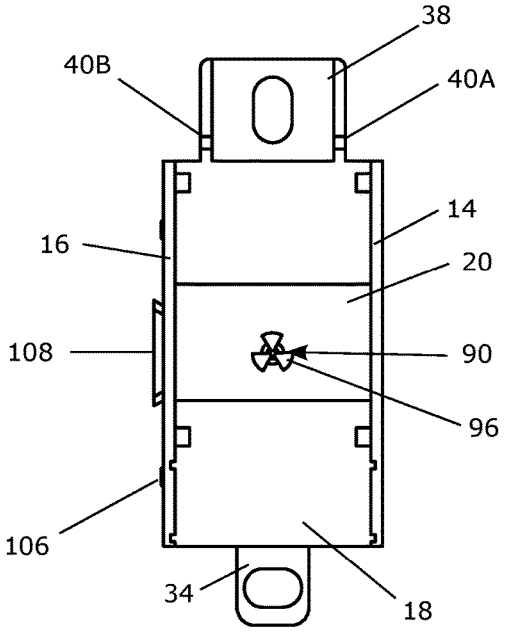
FIG. 14 is a top view of the distribution block of FIG. 1 with a second exemplary block mounting feature.
Figure 15:
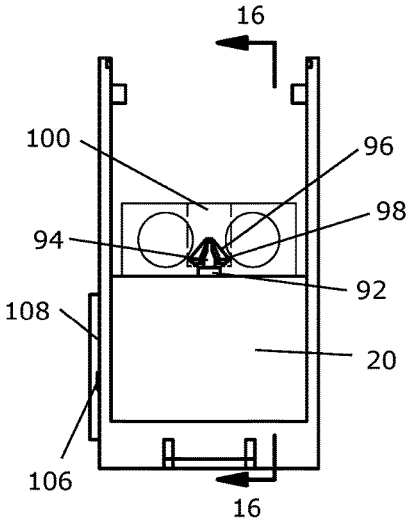
FIG. 15 is a front view of the distribution block of FIG. 14.
Figure 16:
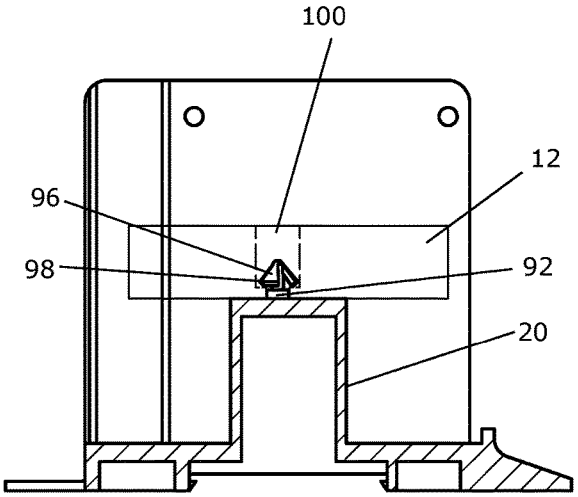
FIG. 16 is a sectional view taken along line 16-16 of the distribution block of FIG. 15.
Figure 17:
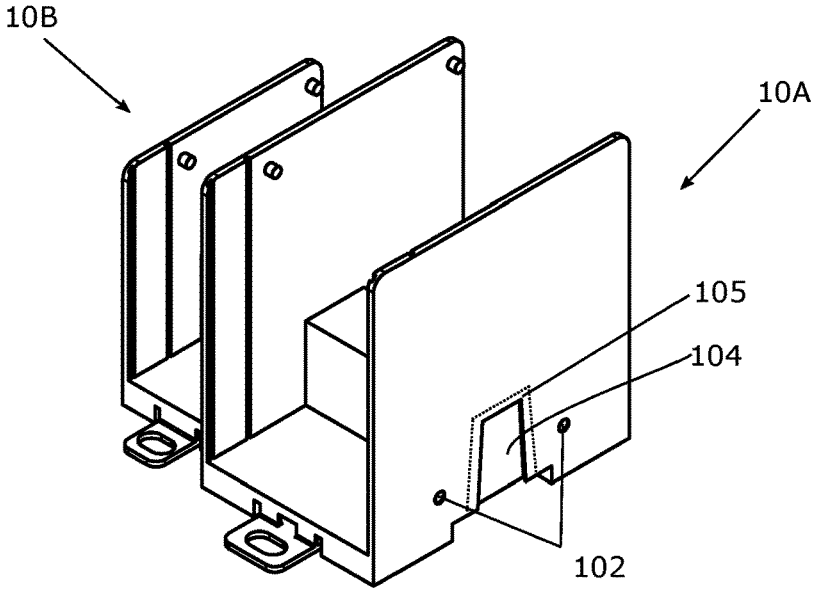
FIG. 17 is a top perspective view of the distribution block of FIG.1 connected to a second exemplary distribution block.

FIGS. 14-16 illustrate an exemplary embodiment of the block mounting feature having a resilient clip, for example a push-in rivet or arrow clip 90 formed integrally with or attached to the pedestal 20. Other types of clips may also be used. The arrow clip 90 is positioned substantially in the center of the pedestal 20 and extends away from the bottom 18. The arrow clip 90 includes a base 92, a stem 94 extending from the base, and one or more blades 96 extending outwardly from the stem 94. In the exemplary embodiment of FIGS. 14-16, three blades 96 are used, equally spaced circumferentially around the stem 94. The blades 96 extend from a tip at the top of the arrow clip 90 to a shoulder 98. The size, shape, location, number of blades 96, and configuration of the arrow clip 90 may vary depending on the configuration of the base 10 and the configuration of the conducting block 12. More than one arrow clip 90 may also be used.

When an arrow clip 90 is used, the conductor block 12 has a mounting aperture 100 as depicted in FIGS. 15 and 16. In an exemplary embodiment, the mounting aperture 100 has a first opening and a second opening substantially coaxial with, and larger than, the first opening. The first and second openings are shown as circular, although they may have any shape. The first opening is sized to be larger than the base 92 of the arrow clip 90. The second opening is sized to be larger than the effective diameter of the arrow clip 90 in an unstressed position. The base of the second opening forms a flange around the first opening. As the conductor block 12 is attached to the pedestal 20, the arrow clip 90 is inserted into the first opening. Because the first opening is smaller than the effective diameter of the blades 96, the blades 96 resiliently compress against the stem 94. The blades 96 expand outwards in the second opening after clearing the first opening. Movement of the conductor block 12 is then resisted by the shoulders 98 of the blades 96 abutting the flange formed by the area around the first opening. In various exemplary embodiments, after connection of the conductor block 12, the blades 96 may be compressed by a user or a tool, allowing the conductor block 12 to be removed from the base 10.

The base 10 may include one or more mating features for connecting a first base with one or more additional bases. The mating features allow bases with different sizes, shapes, and configurations to be connected together in a modular fashion. The modular connection allows a user to form unique groups of distribution blocks as needed for an individual situation.

As shown in FIGS. 17-20, a first base 10A is mated with a second base 10B. The second base 10B is smaller than the first base 10A, although the second base 10B may also be of equal size or larger than the first base 10A. Each base includes a first mating feature and a second mating feature. In certain embodiments, the first mating feature is designed to mate with the second mating feature, so that identical or corresponding mating features may be used to connect different bases. In other alternative embodiments, the mating features of first and second bases 10A, 10B are non-identical, but still capable of mating with one another.

Figure 18:
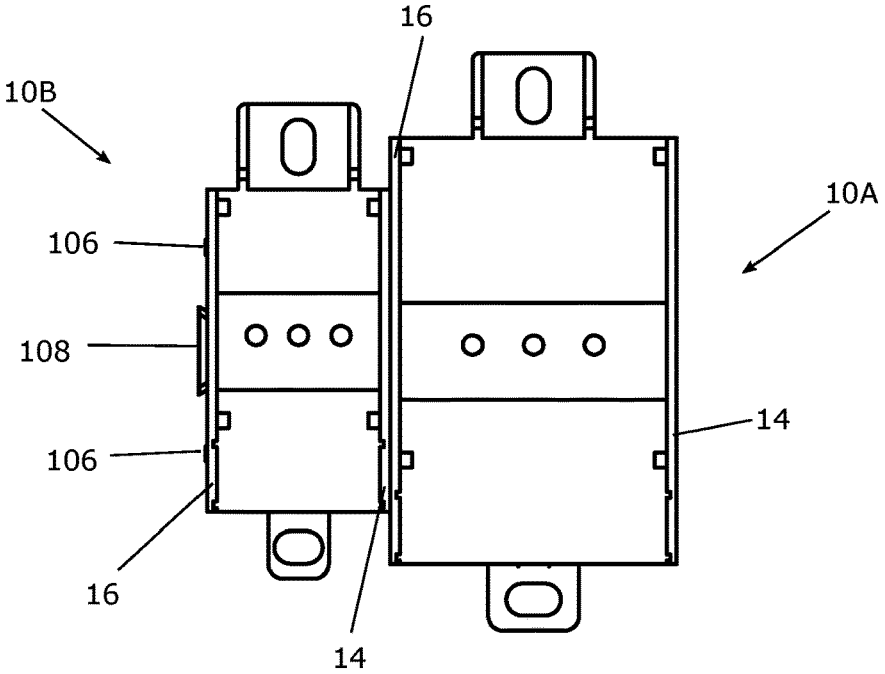
FIG. 18 is a top view of the first and second distribution blocks of FIG. 17.
Figure 19:
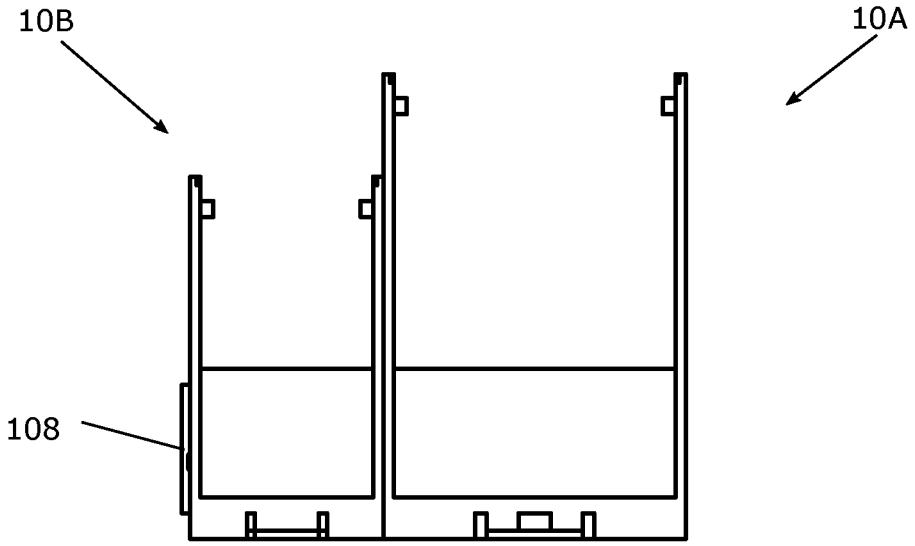
FIG. 19 is a front view of the first and second distribution blocks of FIG. 17.
Figure 20:
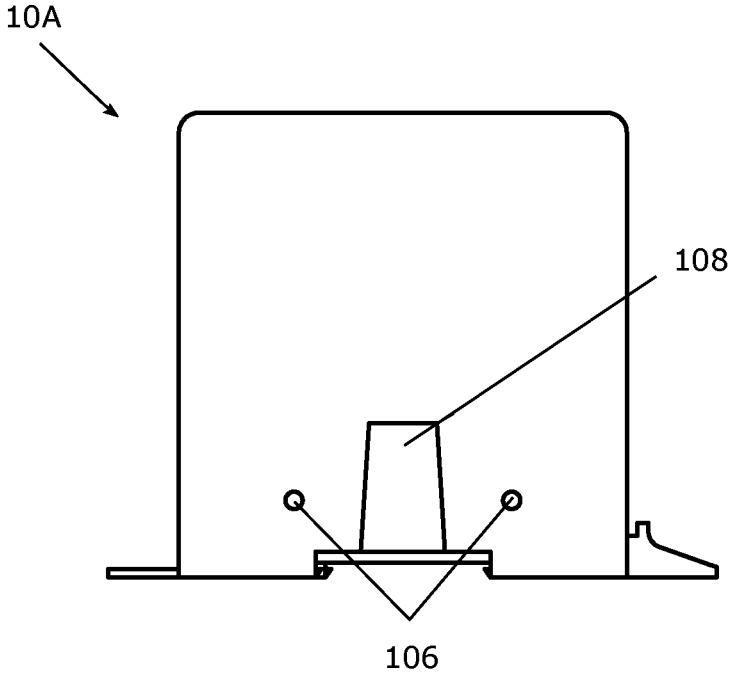
FIG. 20 is a side view of the first and second distribution blocks of FIG.19.
Figure 21:
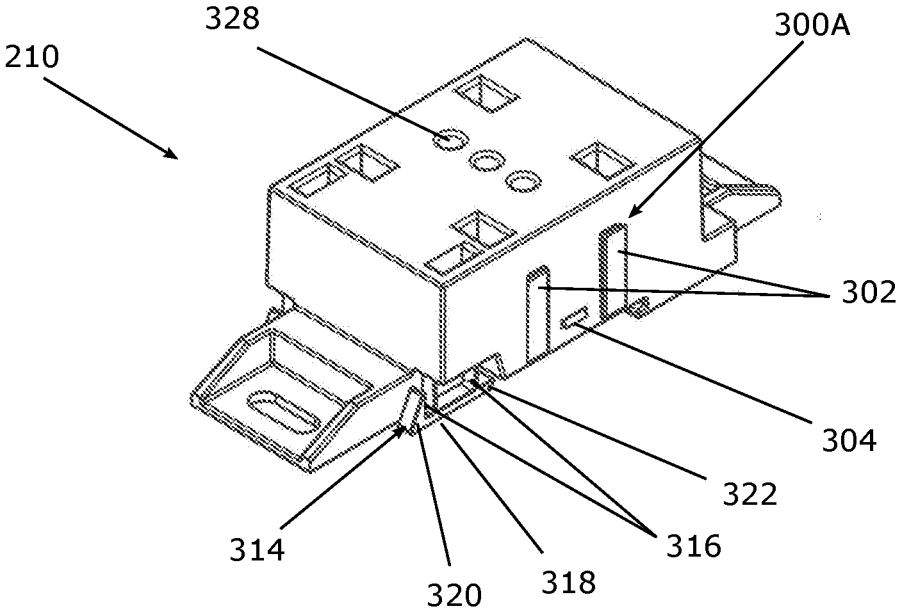
FIG. 21 is a top perspective view of another exemplary base.

In the exemplary embodiment shown in FIGS. 17-20, a pair of depressions 102 and a socket 104 extend into the first sidewall 14. A pair of bulges 106 and a projection 108 extending from the second sidewall 16 and are configured to mate with the depressions 102 and socket 104. The bulges 106 and the projection 109 can be integrally formed with the first sidewall 14. In various exemplary embodiments, the depressions 102 are substantially cylindrical or spherical and the socket 104 has a substantially trapezoidal configuration with a width that narrows from the base to the top. The bulges 106 are substantially cylindrical or spherical and the protrusion 108 has a substantially trapezoidal configuration with a width that narrows from the base to the top. As the bases 10A, 10B are positioned together, the projection 108 mates with the socket 104 and the bulges 106 mate with the depressions 102. As best shown in FIG. 18, and in accordance with an exemplary embodiment, the protrusion 108 tapers from an outer surface to the surface of the second sidewall 16. The first side, second side, and top of the socket 104 may include a flange 105 that extends from the first sidewall 14. The flange 105 allows the socket 104 to slidably receive the mating projection 108 in a vertical direction. The flange 105 slides around the narrowed base of the projection 108 and abuts the wider outer surface, resisting separation of the first and second bases 10A, 10B. The socket 104 and protrusion 108 may have a variety of configurations, for example a square configuration. The mating feature may also include a male and female member, for example a socket and protrusion, on each side of the housing. The mating feature may also be adapted to be placed on bottom 18 section of the base 10 or on the pedestal 20, as well as the sidewalls 14, 16, so that a modular connection may be made between the sidewalls 14, 16 and the bottom 18 or pedestals 20 or directly between bottoms 18 of different bases.

FIGS. 21-47 show another exemplary embodiment of a distribution block 200 having a base 210 for receiving a conductor block 212. The distribution block 200 can have a number of components that are similar to, or the same as, those shown and described in the embodiments of FIGS. 1-20. The base 210 is connected to first and second sidewalls 214. In various exemplary embodiments, the base 210 is made from a plastic or other polymer material and is molded as a unitary structure. Other suitable materials and methods of manufacturing the base 210 may be used. For example, in certain applications the base 210 may be made from a ceramic, metal, elastomer, or composite material. The base 210 may also be formed from separate components that are connected together. In certain embodiments, the base 210 is made from a non-conductive material so that it can be handled by a user when a live connection is made to the conductor block 212.

According to the exemplary embodiment best shown in FIGS. 21-28, the base 210 includes base mating features 300 for releasably connecting the base 210 to the first and second sidewalls 214. The base 210 may also be directly connected to a second, identical or similar base. In certain embodiments, the first and second sidewalls 214 are identical to one another, reducing the number of parts needed and reducing the cost of manufacturing and inventory. The base mating features 300 are positioned on first and second sides of the base. In an exemplary embodiment, the first side of the base includes male base mating features 300A and the second side includes female base mating features 300B, although any combination of male and female mating features may be used on each side.

According to an exemplary embodiment, the male mating feature 300A includes one or more protrusions 302 extending outwardly from the base 210 and a mating tab 304 extending outwardly from the base 210. In the illustrated exemplary embodiment, the mating tab 304 is positioned between two protrusions 302. The protrusions 302 have a substantially planar, rectangular outer surface elongated in the vertical direction. In an exemplary embodiment, the protrusions 302 taper from the outer surface towards the side of the base 210. The mating tab 304 has a substantially triangular cross-section, although one or more of the vertices may be curved. The mating tab 304 has an angled top surface extending from the base 210 and a bottom facing towards the bottom of the base 210.

According to an exemplary embodiment, the female mating feature 300B includes one or more sockets 306 extending into the base 210 and a mating opening 308 extending into or through the second side of the base 210. In the illustrated exemplary embodiment, the mating opening 308 is positioned between two sockets 306. The sockets 306 have a substantially planar, rectangular opening elongated in the vertical direction. In an exemplary embodiment, the sockets 306 taper from a back wall to the rectangular opening, to form a mating relationship with the tapered protrusions 302. The mating opening 308 is a rectangular or square opening configured to receive the mating tab 304. Any size, shape, and configuration of male and female mating features 300A, 300B may be used.

FIGS. 25-28 show two bases 210A, 210B connected to a single sidewall 214 according to an exemplary embodiment. The sidewall 214 includes a first side having a first sidewall mating feature 310A and a second side having a second sidewall mating feature 310B. The first and second sidewall mating features 310A, 310B are configured to mate with the base mating features 300A, 300B. In an exemplary embodiment, the first sidewall mating feature 310A is a set of male mating features and the second sidewall mating feature 310B is a set of female mating features. As best shown in FIGS. 25-28, the mating features 310A, 310B allow the sidewall 214 to be removably connected to a first base 210A and a second base 210B. In an exemplary embodiment, the first and second sidewall mating features 310A, 310B are identical to the first and second base mating features 300A, 300B, respectively.

In various exemplary embodiments, the sidewall 214 includes one or more lid mounting features 222 for attaching a variety of lids to the sidewall 214. The sidewall 214 includes a first side having at least one lid mounting feature 222 and a second side having at least one lid mounting feature 222. The lid mounting features 222 are capable of, and configured to, receive or connect to more than one type of lid. In various exemplary embodiments, the first and second lid mounting features 222 releasably secure the lid to the sidewall 214, allowing a user to change the lid on the distribution block 200 as needed. In the exemplary embodiment, the first and second side of the sidewall 214 include three lid mounting features 222. According to an exemplary embodiment, the lid mounting features 222 are protrusions extending from the sidewall 214 towards the center of the base 210. The protrusions are depicted as substantially cylindrical, although other sizes, shapes and configurations may be used. The placement of the lid mounting features 222 may also be varied.

The sidewall 214 includes a pair of slots 226 with one positioned on the first side and another positioned on the second side. When two sidewalls 214 are connected to a base 210, the slots 226 align to receive different covers depending on the desired configuration.

The base 210 includes a first foot and a second foot extending from opposite edges of the base 210. The first and second feet each include a recessed bottom having an opening extending therethrough. The opening is substantially obround and allows a user to adjustable position the base 210 on a support or other mounting surface (not shown). In an exemplary embodiment, the opening receives mounting hardware, for example a screw or other fastener. The recessed bottom is at least partially bound by a first sidewall and a second sidewall. The first and second sidewalls have an angled portion.

Figure 22:
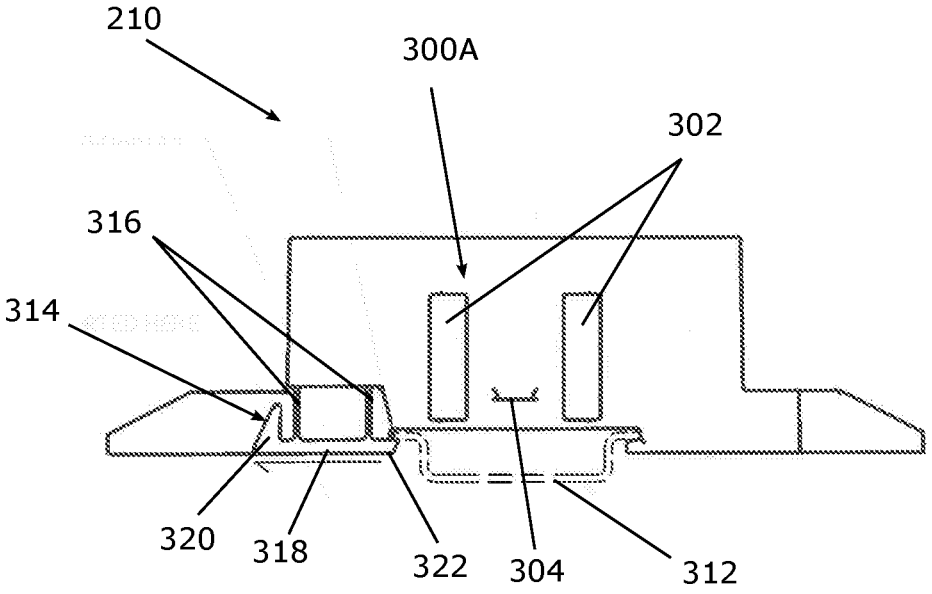
FIG. 22 is a right side view of the base shown in FIG. 21.
Figure 23:
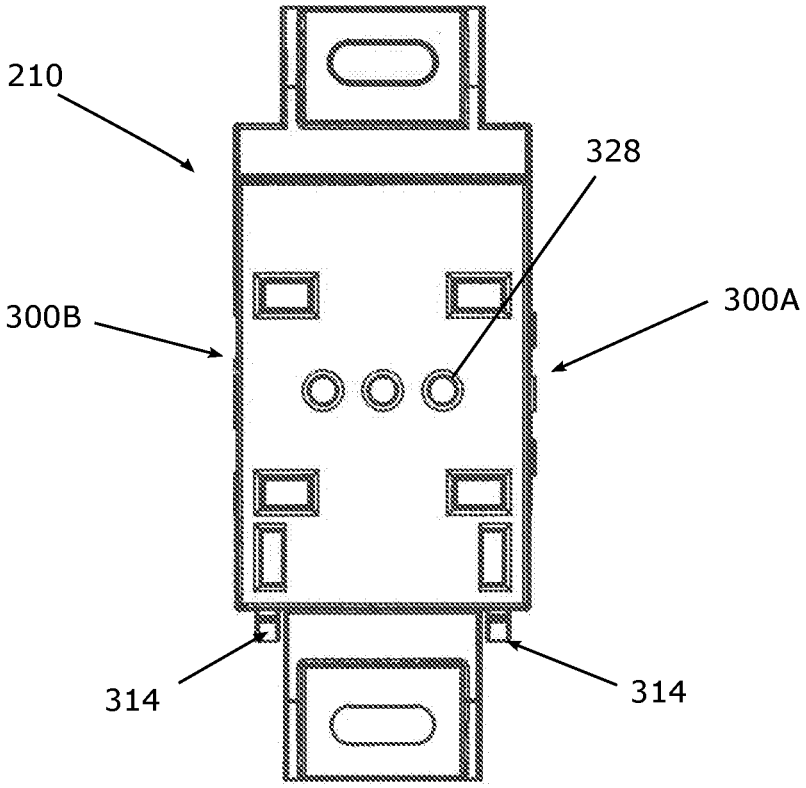
FIG. 23 is a top view of the base shown in FIG. 21.
Figure 24:
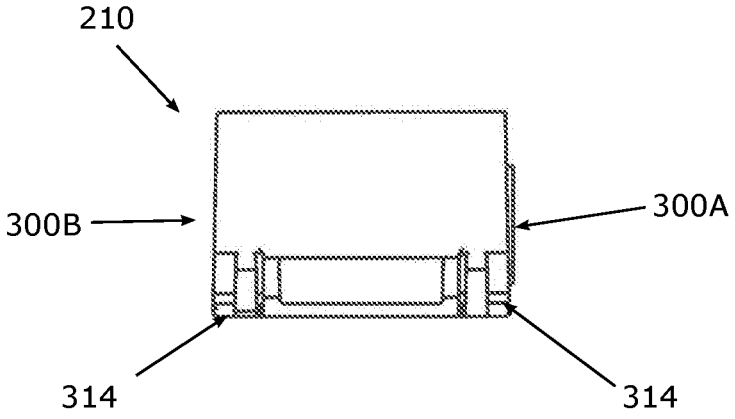
FIG. 24 is a front view of the base shown in FIG. 21.
Figure 25:
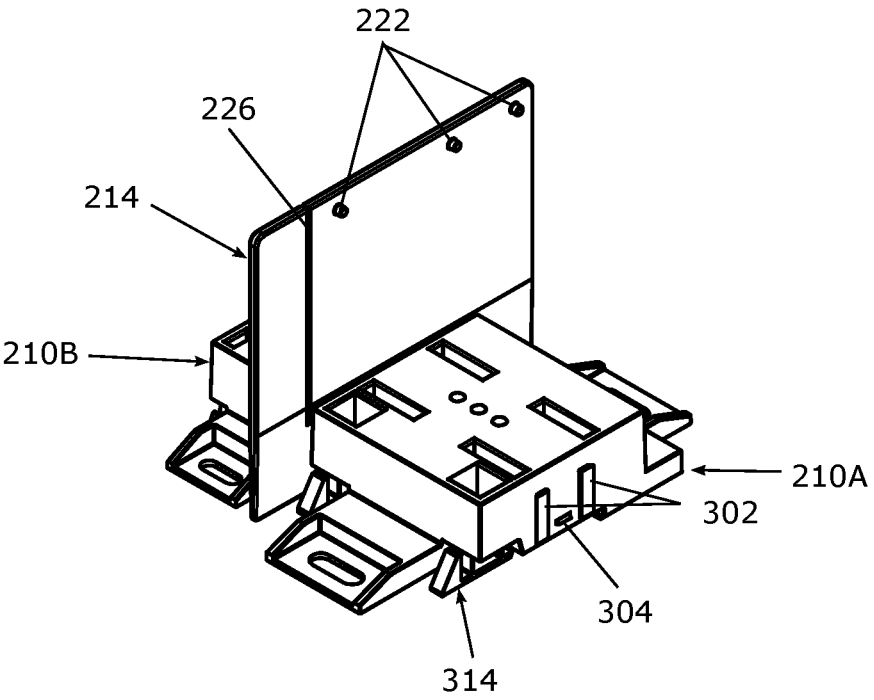
FIG. 25 is a top perspective view of an exemplary first base, second base, and sidewall.
Figure 26:
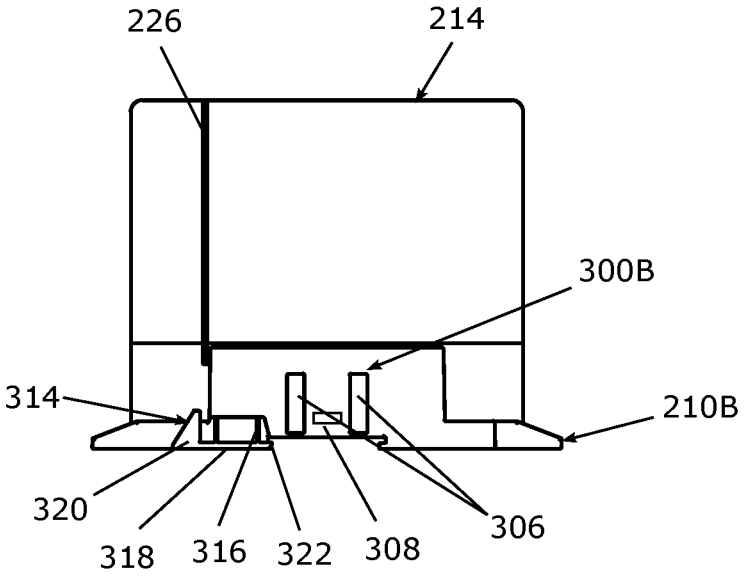
FIG. 26 is a right side elevational view of the bases and sidewall shown in FIG. 25.
Figure 27:
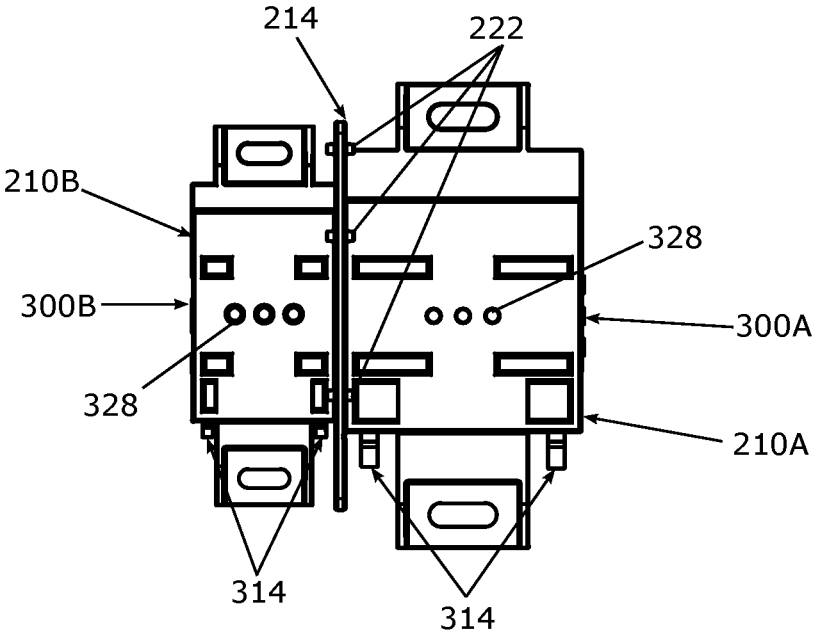
FIG. 27 is a top view of the bases and sidewall shown in FIG. 25.
Figure 28:
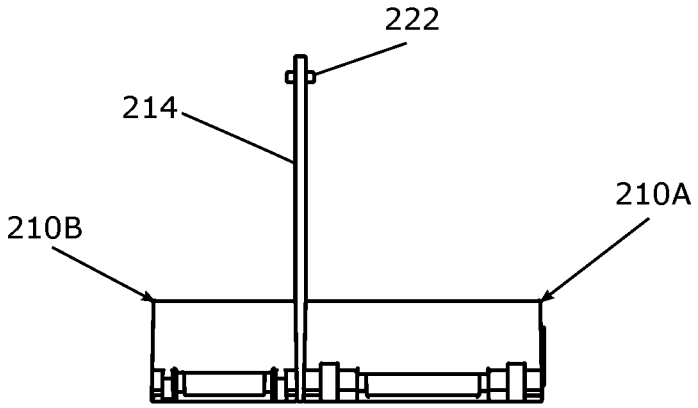
FIG. 28 is a front view of the bases and sidewall shown in FIG. 25.
Figure 29:
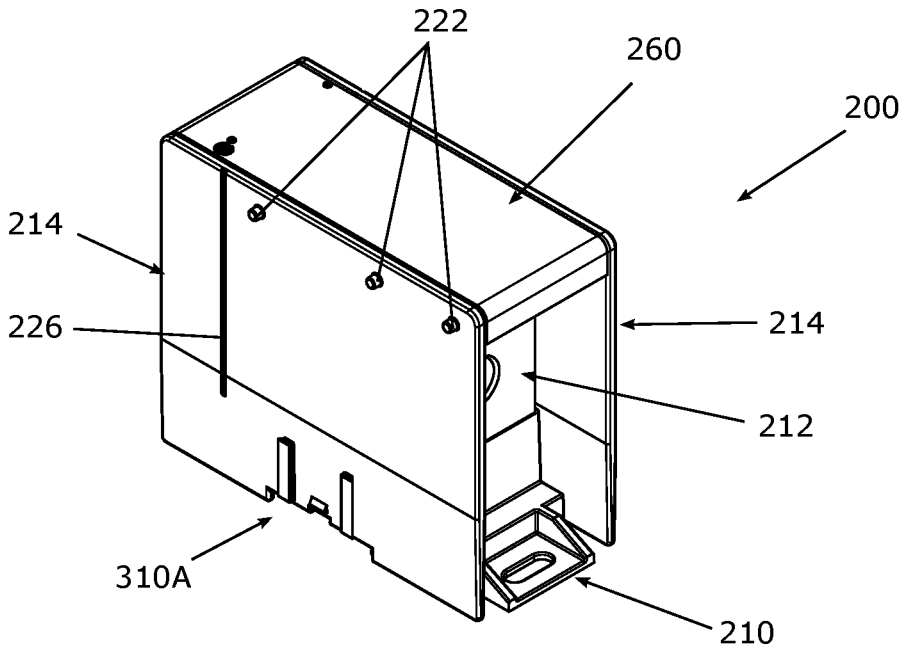
FIG. 29 is a top perspective view of an exemplary distribution block having a first lid.
Figure 30:
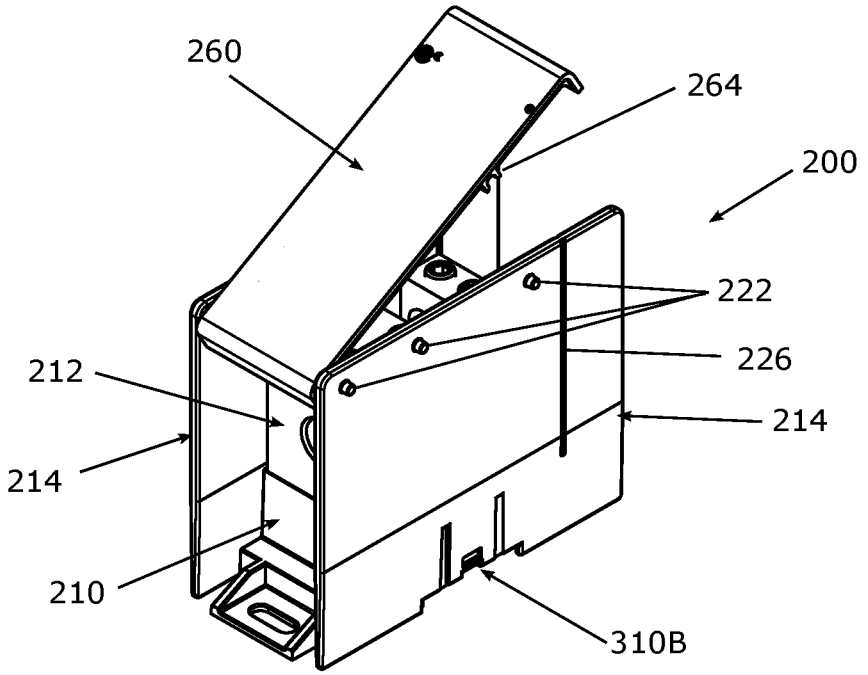
FIG. 30 is a top perspective view of the distribution block of FIG. 29 with the lid pivoted open.
Figure 31:
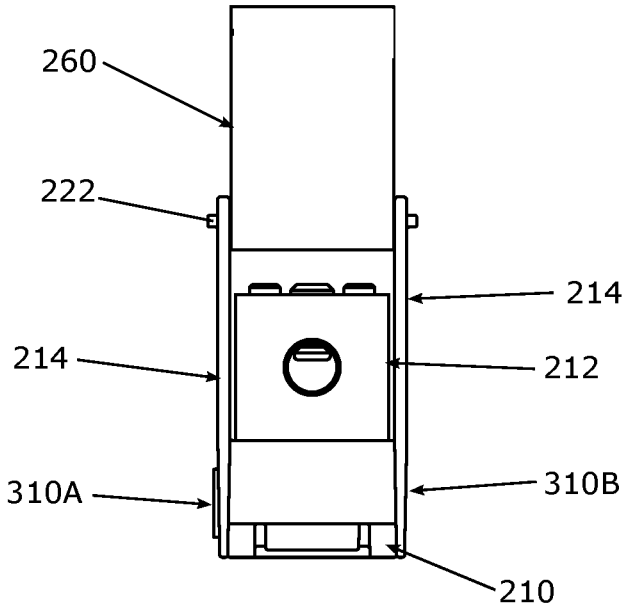
FIG. 31 is a front view of the block shown in FIG. 30.
Figure 32:
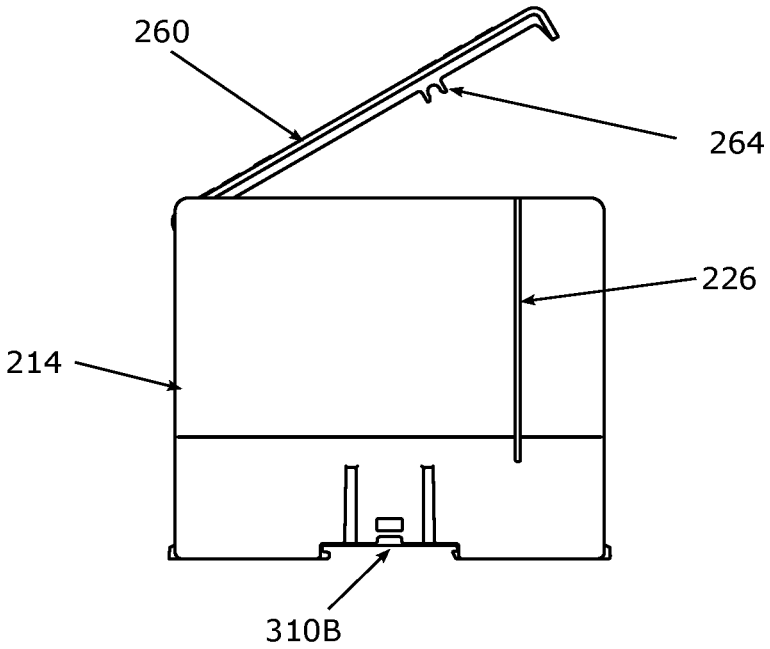
FIG. 32 is a right side view of the block shown in FIG. 30.

The base 210 can also include a support connecting feature. The support connecting feature can releasably connect the base to a support. In an exemplary embodiment, the support connecting feature includes a channel for attaching the base 210 to a DIN rail 312, as best shown in FIG. 22. The base 210 may be angled, slid, or snap-fitted to the DIN 312 rail based on the configuration of the channel. According to an exemplary embodiment, the channel is bordered on a first end by a first prong and on a second end by a release mechanism 314. In an exemplary embodiment, the release mechanism 314 includes at least one column 316 extending from the base 210 to connect a leg 318. The leg 318 includes a tab 320 at a first end and a second prong 322 at a second end. The tab 320 extends upwardly from the leg 318 towards the top of the base 210 and has an angled front surface. The second prong 322 has an angled rear surface for engaging the DIN rail 312, although other shapes and configurations may also be used.

The base 210 can be angled around the DIN rail 312 so that the first prong slidingly engages the DIN rail 312 and the leg 318 is snap fit onto the DIN rail 312. The leg 318 may bend or flex to allow for the connection to the DIN rail 312. To release the base 210, a user can apply a force, for example a force in a direction away from the DIN rail 312 or a downward force, to the release mechanism 314, to move, flex, or rotate the second prong 322 out of engagement with the DIN rail 312. The user may apply a force by hand or with a tool, for example a screw driver. In an exemplary embodiment, a tool may be placed between the tab 320 and the column 316 to apply a force to the release mechanism 314 in a direction away from the DIN rail 312.

FIGS. 29-34 depict the base 210 connected to a conductor block 212 and a first lid 260, according to an exemplary embodiment. In this exemplary embodiment, the conductor block 212 is connected to the base 210 with a mechanical fastener. The conductor block 212 includes a primary side and a tap side. The primary side includes a primary conductor opening to receive and seat a primary conductor. The tap side includes one or more tap conductor openings to receive and seat one or more tap conductors. In various exemplary embodiments, the conductor block 212 is machined from a single piece of material to have a unitary structure, although multiple pieces may be used and connected together. In various exemplary embodiments, the primary conductor opening and the tap conductor openings are substantially circular. Conductor blocks having various combinations and configurations of primary sides and tap sides, including different number, sizes, and shapes of tap openings, may be used as would be understood by one of ordinary skill in the art when viewing this disclosure.

Figure 33:
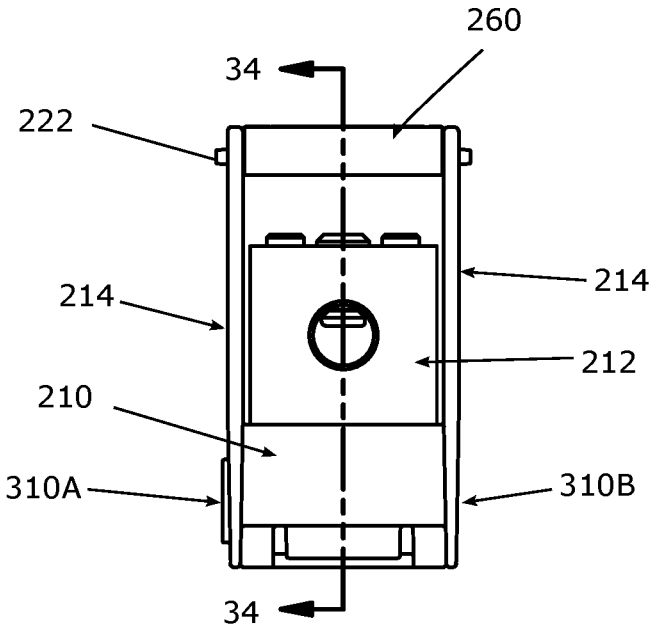
FIG. 33 is a front view of the block shown in FIG. 30.
Figure 34:
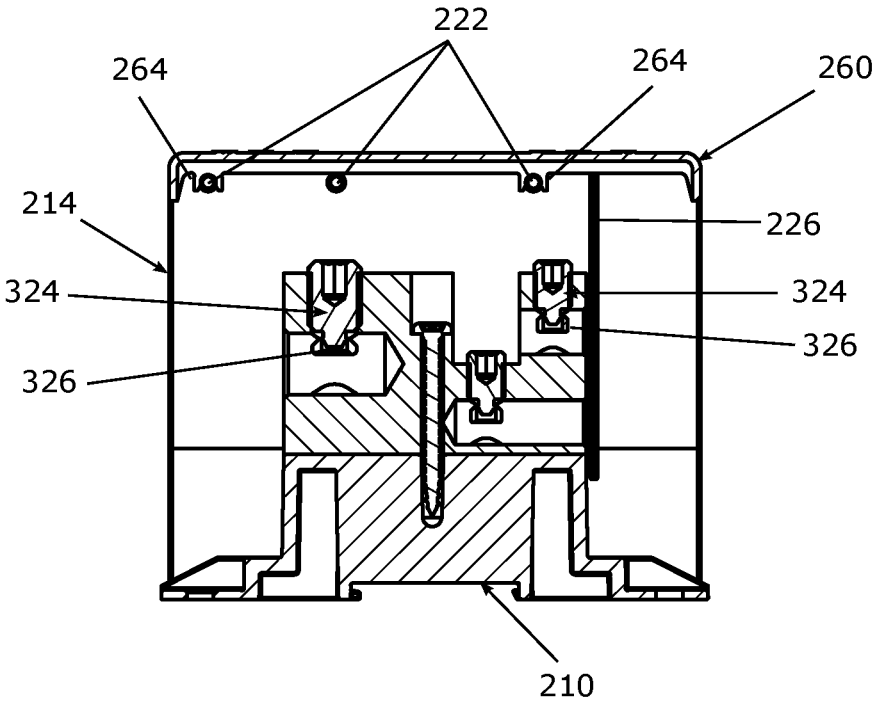
FIG. 34 is a sectional view of FIG. 33 taken along line 34-34.
Figure 35:
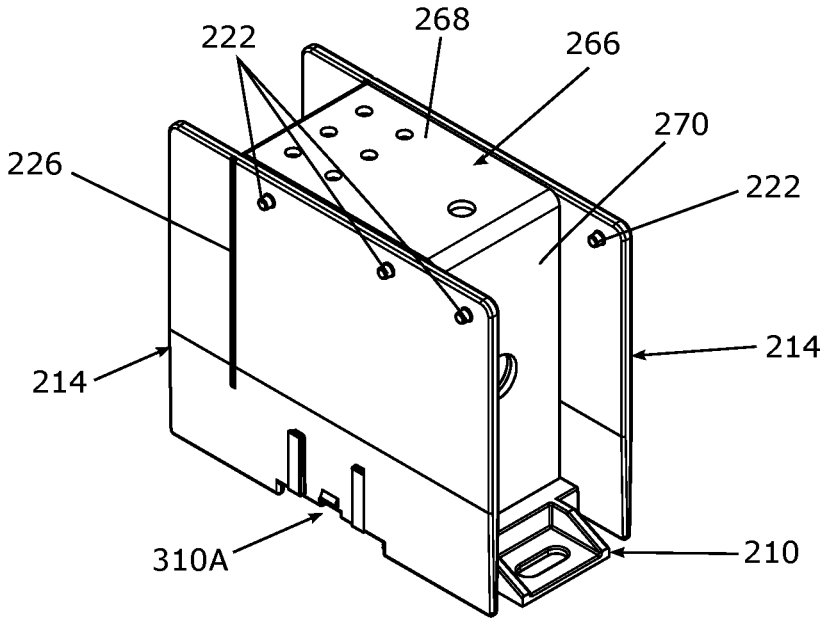
FIG. 35 is a top perspective view of an exemplary distribution block having a second lid.
Figure 36:
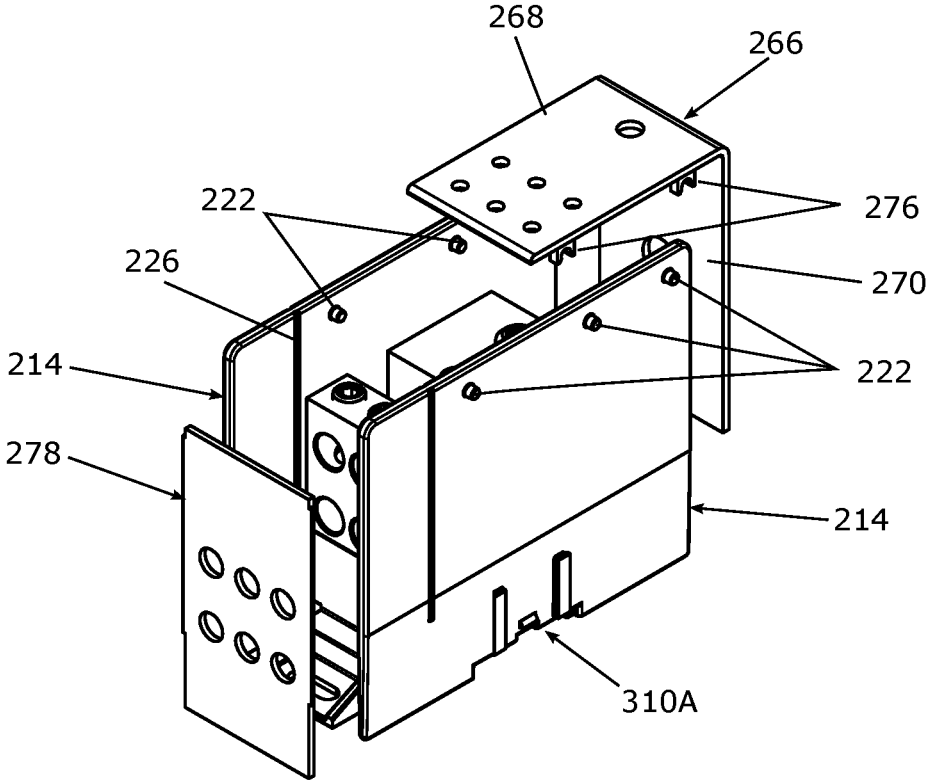
FIG. 36 is a partially exploded top perspective view of the block shown in FIG. 35.
Figure 37:
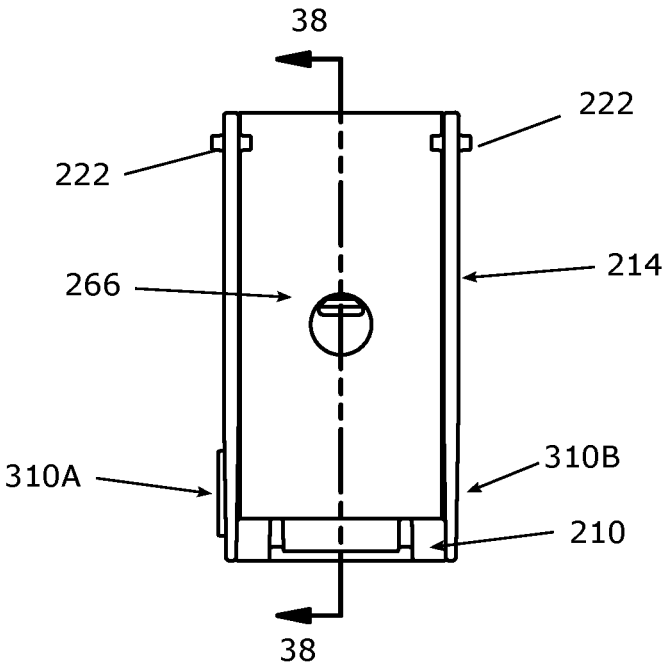
FIG. 37 is a front view of the block shown in FIG. 35.

As best shown in the exemplary embodiment of FIGS. 33 and 34, the primary conductor opening has an associated top aperture and the tap opening has an associated top aperture. The top apertures may be threaded for receiving a fastener 324, for example a set screw type fastener. In the exemplary embodiment of FIG. 34, the fastener 324 includes a pressure pad 326 for contacting the conductor. The pressure pad 326 is substantially circular and is rotatably connected to the shaft of the fastener 324. As the fastener is tightened, the pressure pad 326 contacts the conductor. When the friction between the pressure pad 326 and the conductor overcomes the friction between the pressure pad 326 and the shaft of the fastener 324, the shaft will rotate independently of the pressure pad 326, which will not rotate, or have minimal rotation with respect to the conductor. This helps prevent the fastener 324 from grinding into the conductor and damaging individual conductor strands.

According to an exemplary embodiment, the lid 260 includes a top surface and a bottom surface. The top surface has a curved front end and a curved back end, although neither end or only one end may be curved. One or more lid connecting features 264 extend from the bottom surface to connect the lid 260 to the sidewall 214 by engaging associated lid mounting features 222, for example the first and third lid mounting features. The lid connecting features 264 may extend from the bottom surface or from a flange extending from the bottom surface and have an opening, for example a substantially U-shaped or a half circle. The openings allow the rear lid connecting features 264 to snap-connect to the lid mounting features 222 and pivotally connect the lid 260 to the base 210. In an exemplary embodiment, the lid 260 is molded from a translucent, polymer material. In other alternative embodiments, the first lid 260 is made from other suitable materials such as metal, plastic, or composite materials and has any level of opacity.

FIGS. 35-38 illustrate another exemplary lid 266 connected to the base 210. The lid 266 includes a first section 268 extending along a top edge of the first and second sidewalls 214 and a second section 270 extending from the first section 268 towards the base 210. The second section 270 extends at substantially a right angle to the first section 268. A curved edge connects the first section 268 to the second section 270 although various types of edges may be used.

In various exemplary embodiments, the first section 268 is a top section having a top surface and a bottom surface. A primary aperture and one or more tap apertures extend through the top section. The number of tap apertures will depend on the configuration of the tap side of the conductor block 212. The primary and tap apertures provide access to the set screws in the primary and tap sections of the conductor block 212. In various exemplary embodiments, the primary and tap apertures are finger-safe apertures sized to allow a tool or driver to be inserted through the lid 266 but prevent a user's finger from being placed through the lid 266 and in contact with the conductor block 212.

In various exemplary embodiments, the second section 270 includes an exterior surface and an interior surface. The second section 270 extends substantially between the first and second sidewalls 214 and along substantially the entire height of the first and second sidewalls 214. One or more apertures extend through the second section 270 to provide access for a primary conductor to the primary block.

The lid 266 includes lid connecting features 276 extending from a bottom surface to connect the lid 266 to the base 210 by engaging the lid mounting features 222, for example the second and third lid mounting features 222. In the illustrated exemplary embodiment, the lid connecting features 276 have a downwardly facing opening for mating with the lid mounting features 222. The openings may be substantially U-shaped or a half circle. The openings allow the lid connecting features 276 to snap-connect to the projections of the lid mounting features 222, respectively. The connection helps retain the lid 266 to the base 210 to prevent accidental contact with the conductor block 212 during use. In an exemplary embodiment, the lid 266 is molded from a translucent, polymer material. In other alternative embodiments, the lid 266 is made from other suitable materials such as metal, plastic, or composite materials and has any level of opacity.

Figure 38:
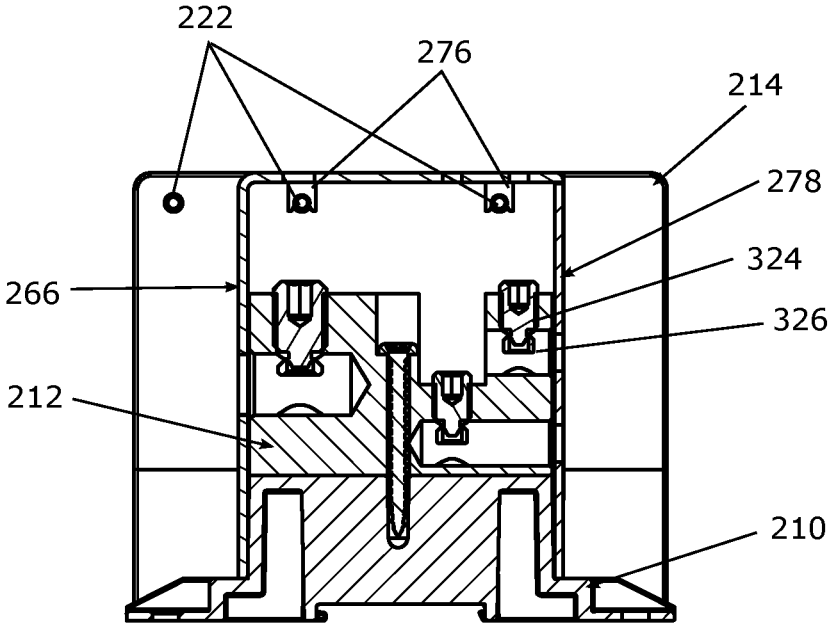
FIG. 38 is a sectional view of FIG. 37 taken along line 38-38.

In various exemplary embodiments, the lid 266 is used in connection with a front cover 278 to further enclose the conductor block 212. The front cover 278 is substantially planar and is configured to slide into the slot in the sidewall 214. When the lid 266 is connected to the base 210, a top edge of the front cover 278 is adjacent to or in contact with the bottom surface of the first section 268. The front cover 278 includes one or more apertures to provide access for tap conductors to the tap block. The number of apertures will depend on the configuration of the tap section of the conductor block 212. For example, as shown in FIG. 38, the tap block receives multiple tap conductors, having a first tier with one or more openings and a second tier positioned above the first tier with one or more openings. The first and second tiers are offset in a stair-like configuration.

In various exemplary embodiments, one or more block mounting features extend from base 210 to engage and retain the conductor block 212. The block mounting feature is capable of, and configured to, receive more than one type of conductor block 212. In various exemplary embodiments, the block mounting feature releasably secures the conductor block 212 to the base 210, allowing a user to change conductor blocks 212 on a given base 210 as needed. The block mounting feature may be integrally formed with the base 210, for example by molding, or separately formed and connected to the base 210.

In the exemplary embodiment shown in FIGS. 21-28, the block mounting feature includes one or more openings 328 for receiving a mechanical fastener, for example three openings 328. The three openings 328 can be used to connect conductor blocks 212 having different sizes and configurations. For example, different conductor blocks 212 may have a different position, or positions, for a mounting hole. In certain configurations, a conductor block utilizes the outer two openings 328 while in other configurations a conductor block utilizes only the middle opening 328.

Figure 39:
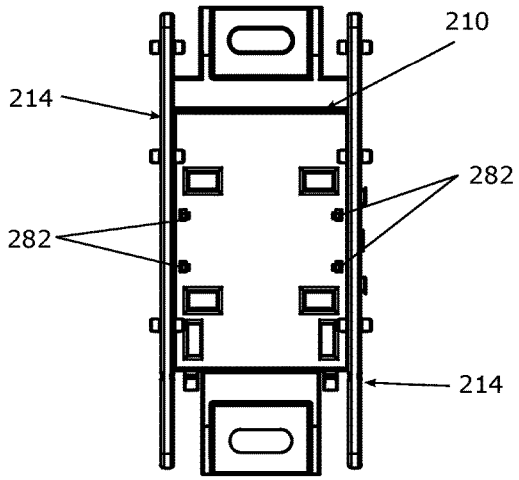
FIG. 39 is a top view of an exemplary distribution block with an exemplary conductor block mounting feature.
Figure 40:
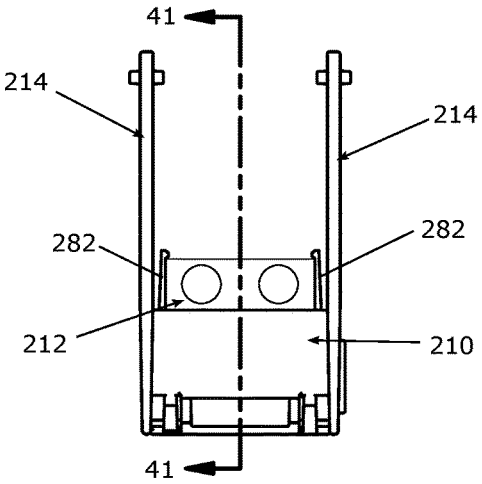
FIG. 40 is a front view of the block shown in FIG. 39.
Figure 41:
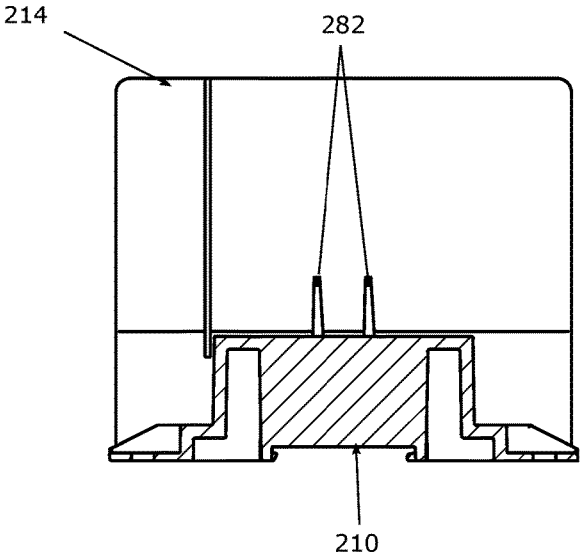
FIG. 41 is a sectional view of FIG. 40 taken along line 41-41.

FIGS. 39-41 illustrate an exemplary embodiment of the block mounting feature having one or more arms 282, for example four arms 282. The arms 282 may be configured and function similar or identical to the exemplary embodiment in FIGS. 10-13, although different sizes, shapes, and configurations may be used.

Figure 42:
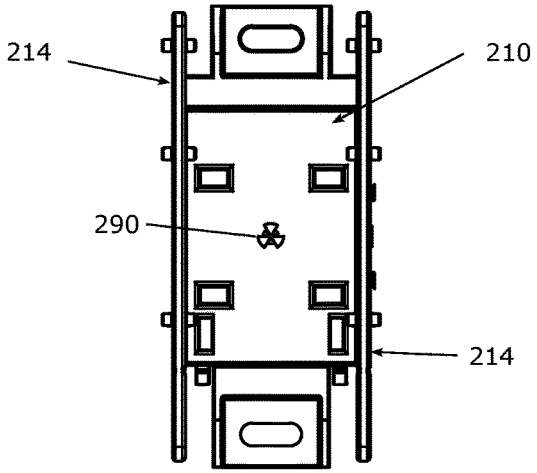
FIG. 42 is a top view of an exemplary distribution block with another exemplary conductor block mounting feature.
Figure 43:
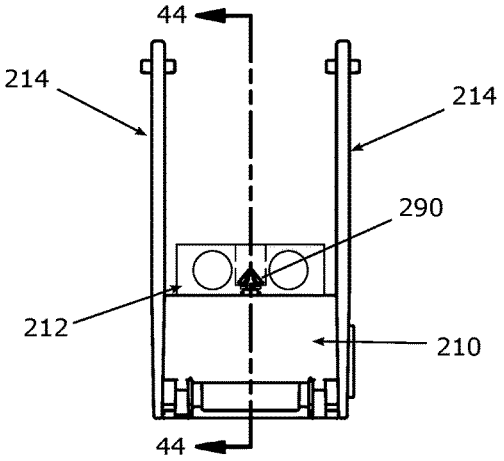
FIG. 43 is a front view of the block shown in FIG. 42.
Figure 44:
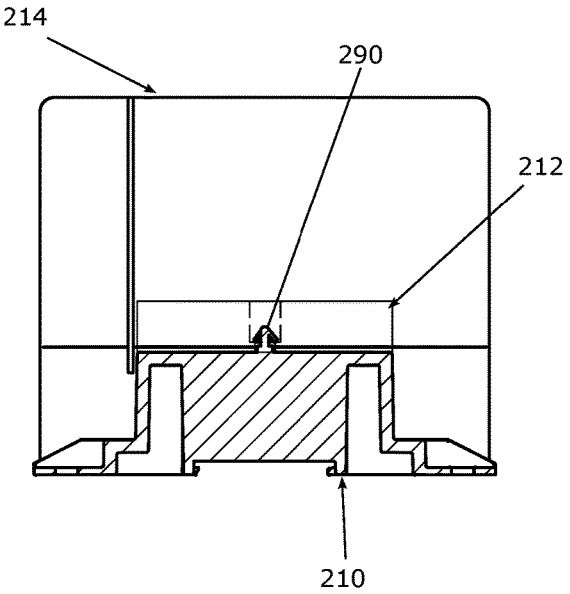
FIG. 44 is a sectional view of FIG. 43 taken along line 44-44.

FIGS. 42-44 illustrate an exemplary embodiment of the block mounting feature having a resilient clip, for example a push-in rivet or arrow clip 290. Other types of clips may also be used. The arrow clip 290 is positioned substantially in the center of the base 210, and can be formed integrally with the base 210. The arrow clip 290 may be configured and function similar or identical to the exemplary embodiment shown in FIGS. 14-16, although different sizes, shapes, and configurations may be used.

Figure 45:
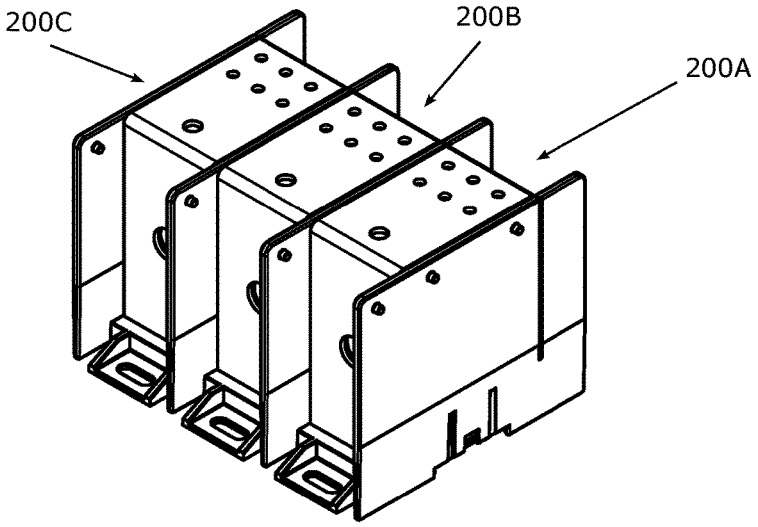
FIG. 45 is a top perspective view of a plurality of exemplary distribution blocks connected to one another.
Figure 46:
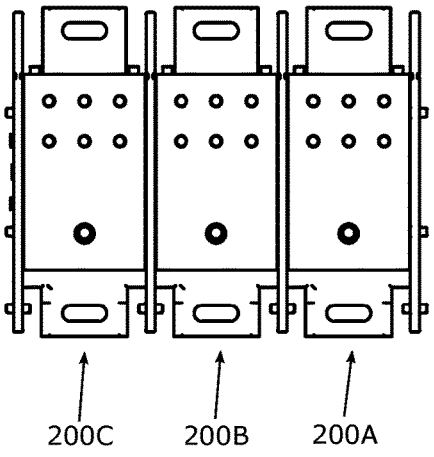
FIG. 46 is a top view of the blocks shown in FIG. 45.
Figure 47:
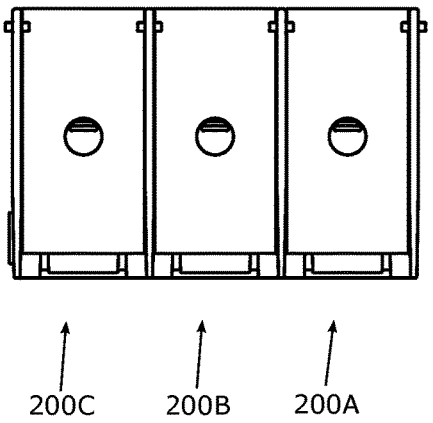
FIG. 47 is a front view of the blocks shown in FIG. 45.
Figure 48:
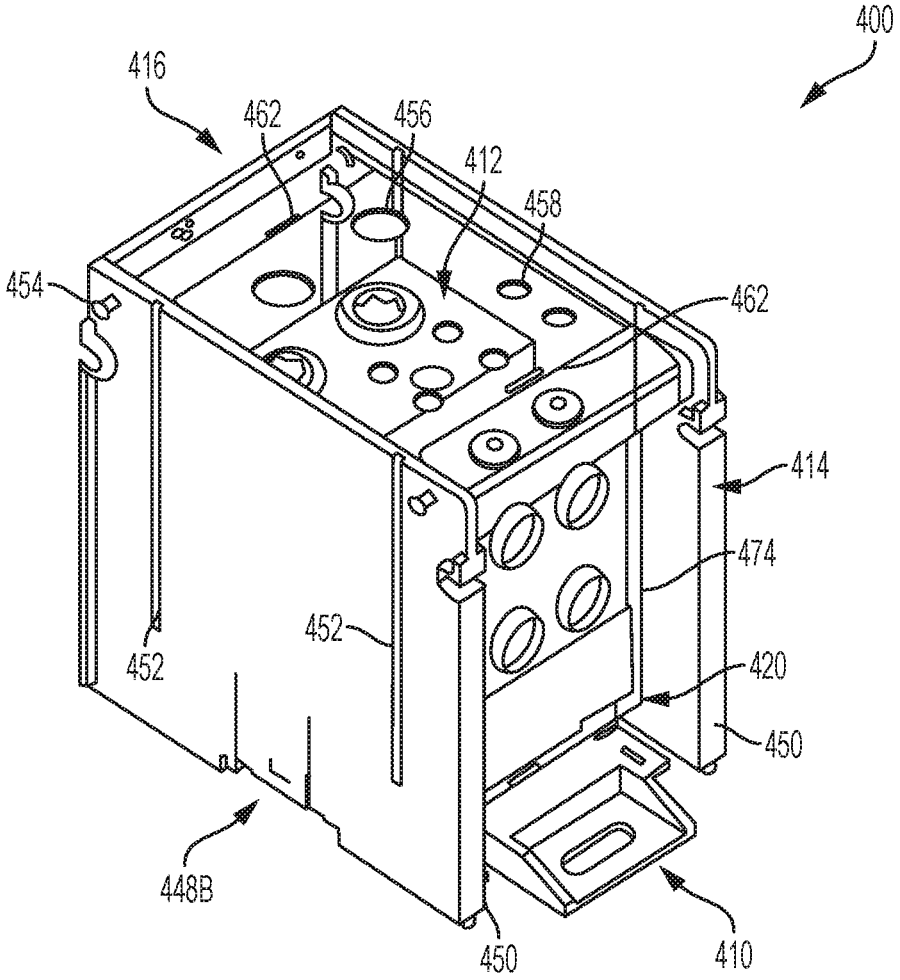
FIG. 48 is a top perspective view of another exemplary distribution block.
Figure 49:
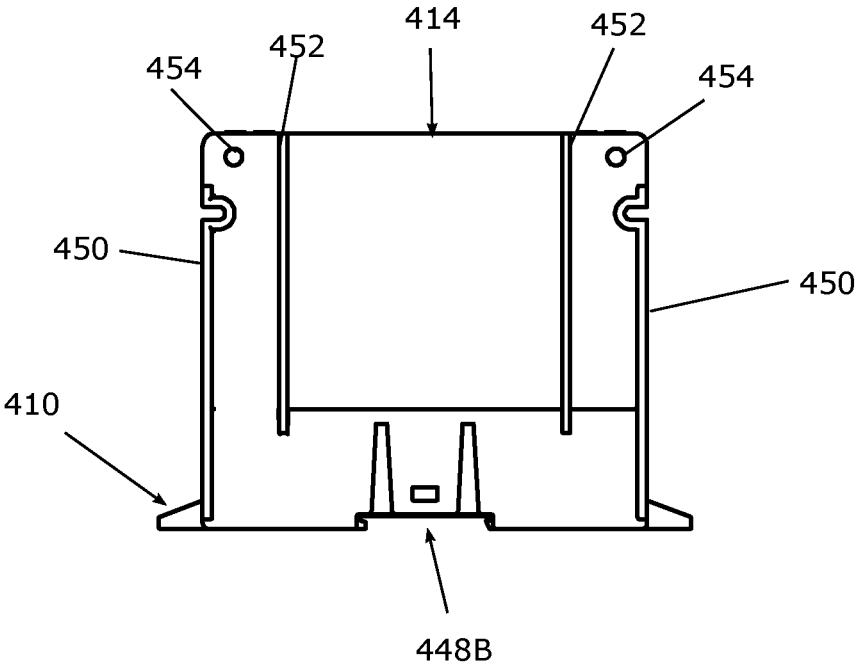
FIG. 49 is a right side view of the block shown in FIG. 48.
Figure 50:
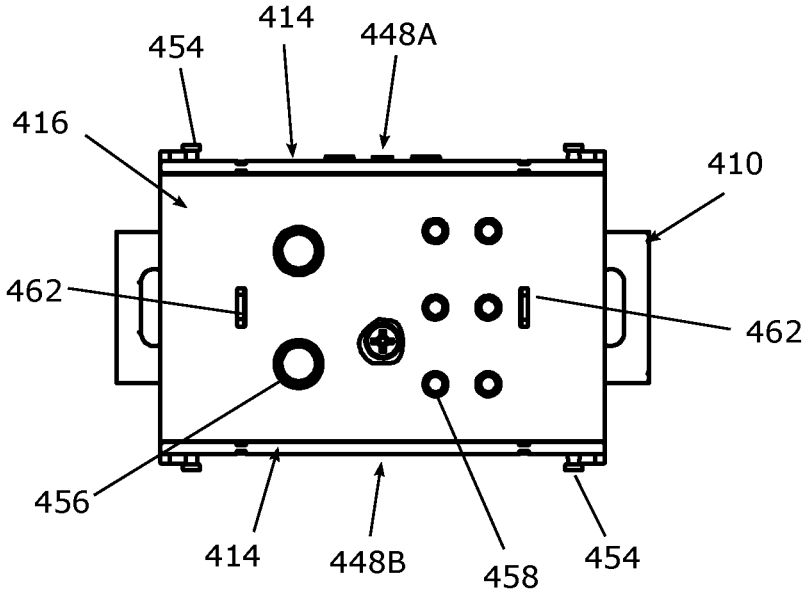
FIG. 50 is a top view of the block shown in FIG. 48.
Figure 51:
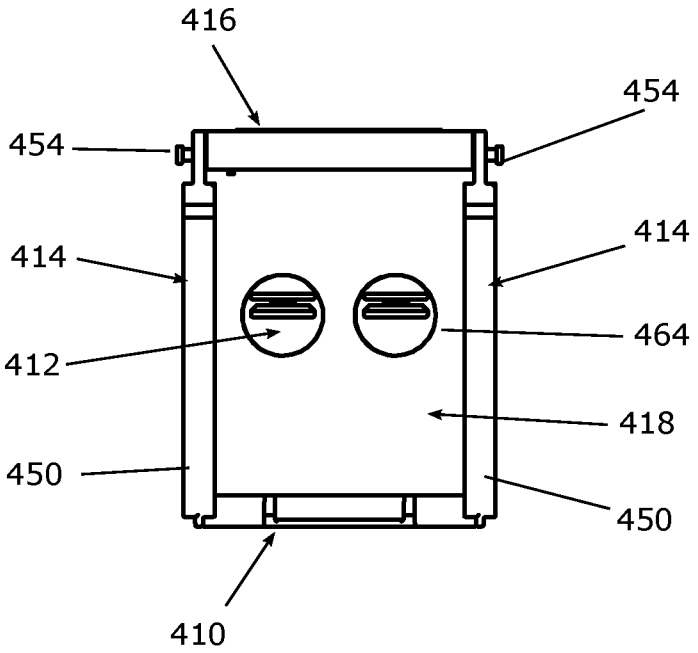
FIG. 51 is a rear view of the block shown in FIG. 48.
Figure 52:
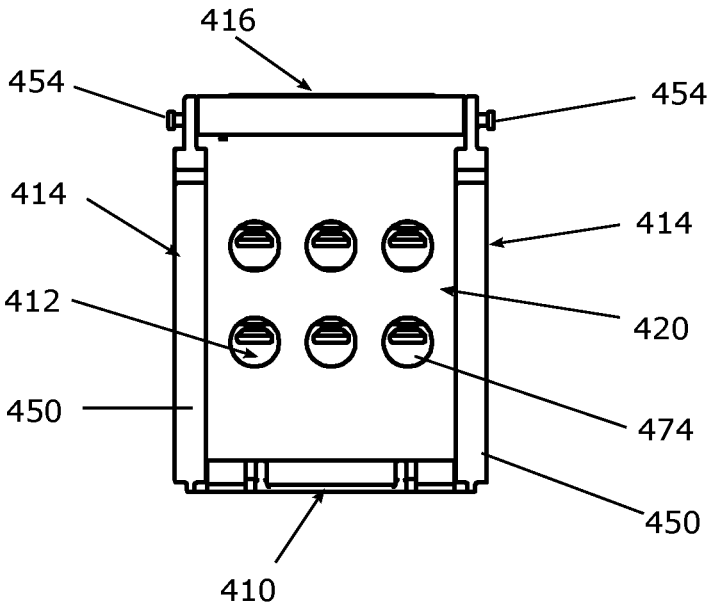
FIG. 52 is a front view of the block shown in FIG. 48.
Figure 53:
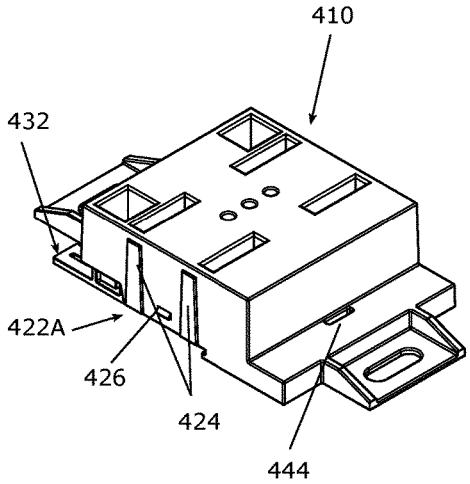
FIG. 53 is a top perspective view of the block shown in FIG. 48.
Figure 54:
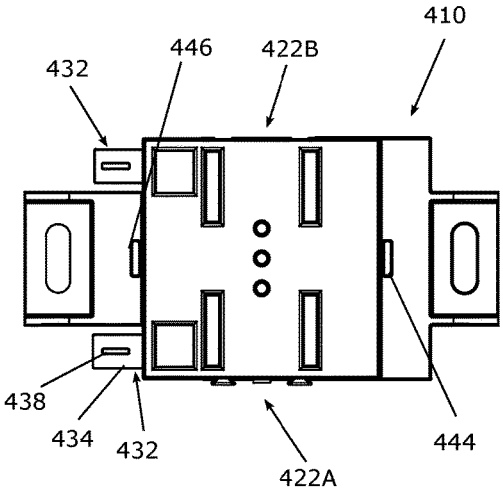
FIG. 54 is a top view of the block shown in FIG. 53.
Figure 55:
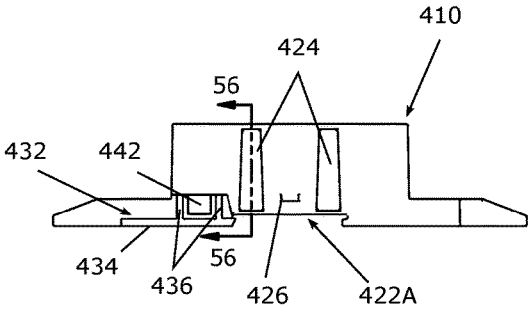
FIG. 55 is a right side view of the block shown in FIG. 53.
Figure 56:
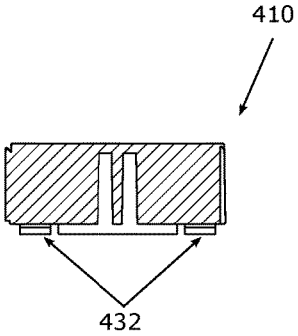
FIG. 56 is a sectional view of FIG. 55 taken along line 56-56.
Figure 57:
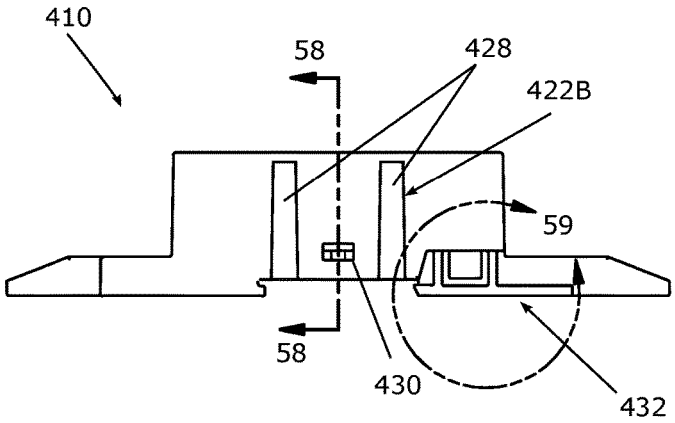
FIG. 57 is a left side view of the block shown in FIG. 53.
Figure 58:
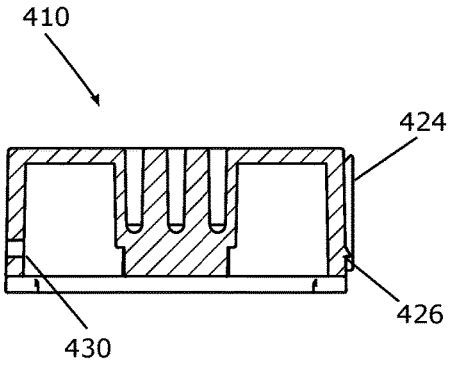
FIG. 58 is a sectional view of FIG. 57 taken along line 58-58.
Figure 59:
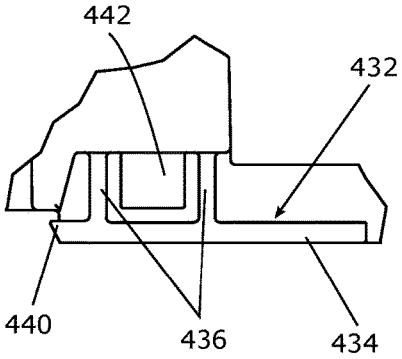
FIG. 59 is an enlarged, right side view of area 59 of FIG. 57.
Figure 60:
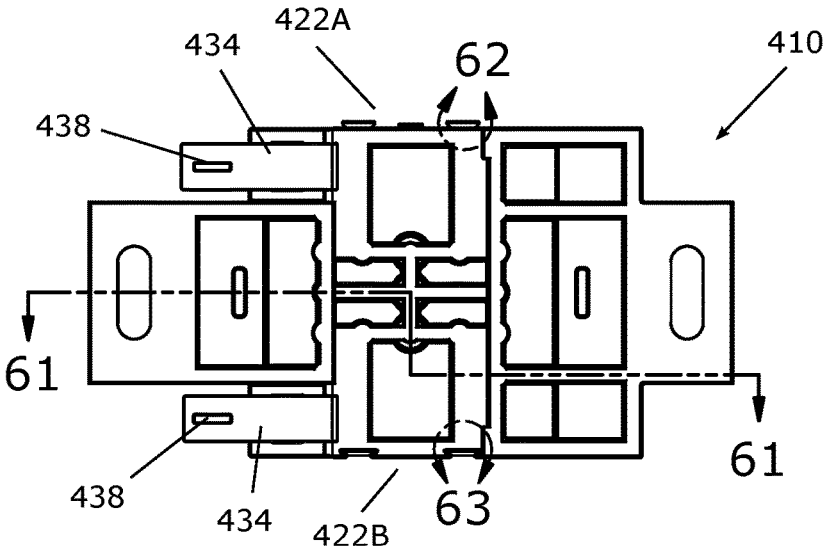
FIG. 60 is a bottom view of the block shown in FIG. 53.
Figure 61:
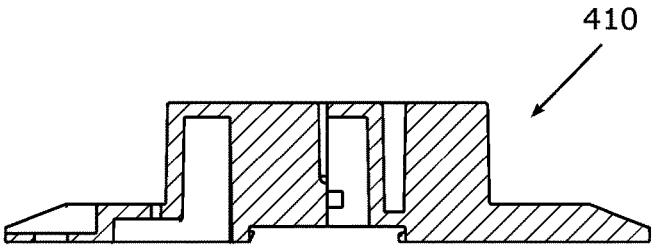
FIG. 61 is a sectional view of FIG. 60 taken along line 61-61.

FIGS. 45-47 depict an exemplary embodiment of three distribution blocks 200A-200C connected together to form a distribution module. The distribution blocks 200A-200C each include a base 210, sidewalls 214, and cover 266. In various exemplary embodiments, all three distribution blocks 200A-200C are identical. In other exemplary embodiments, various sizes and configurations of distribution blocks 200A-200C may be connected together to form variable modules, including different bases, sidewalls, lids, and conductor blocks. By utilizing the different base, wall and lid mating and mounting features, a user can select different types of bases, walls, lids, and conductor blocks to meet multiple needs. One or more bases 210 may also be directly connected, both physically and/or electrically to transfer electrical power from one conductor block 212 to another. In certain exemplary embodiments, the distribution blocks can utilize bases, walls, lids, conductor blocks and/or additional components that enable them to function as a lay-in distribution block where a conductor does not need to be stripped or exposed prior to attachment. Accordingly, a wider range of products can be offered at reduced manufacturing and inventory costs.

FIGS. 48-72 depict another exemplary embodiment of a distribution block 400 having a base 410, a conductor block 412, a pair of sidewalls 414, a top lid 416, a primary cover 418, and a tap cover 420. The distribution block 400 has a number of components that are similar or the same to those shown and described in the embodiments of FIGS. 1-47.

FIGS. 53-63 depict an exemplary embodiment of the base 410. The base 410 includes one or more base mating features 422. The base mating features 422 include male mating features 422A on a first side and female mating features 422B on a second side, although any combination of male and female mating features may be used on each side.

Figure 62:
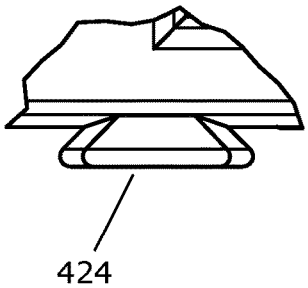
FIG. 62 is an enlarged, bottom view of area 62 of FIG. 60.
Figure 63:
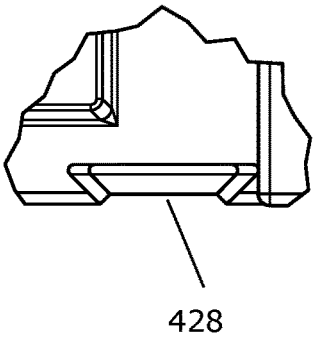
FIG. 63 is an enlarged, bottom view of area 63 of FIG. 60.
Figure 64:
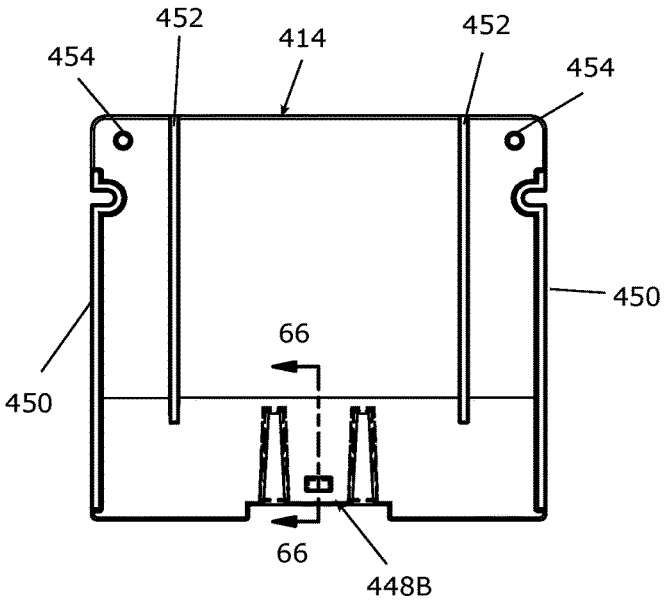
FIG. 64 is a right side elevational view of an exemplary sidewall.
Figure 65:
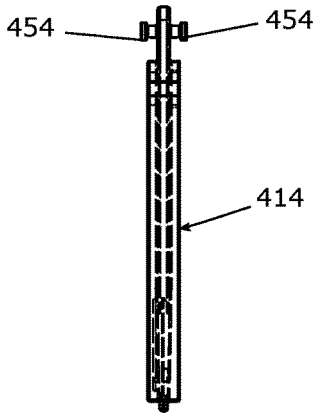
FIG. 65 is a front view of the sidewall shown in FIG. 64
Figure 66:
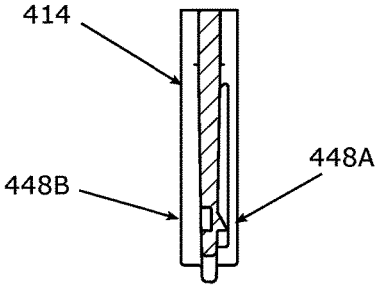
FIG. 66 a sectional view of FIG. 64 taken along line 66-66.
Figure 67:
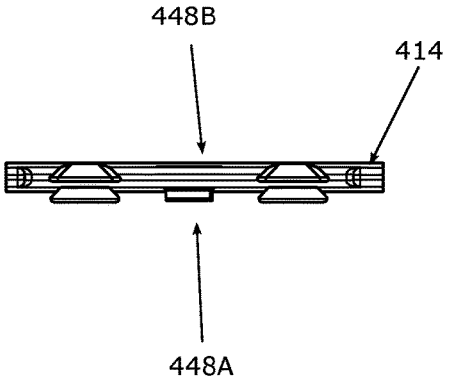
FIG. 67 is a partial, bottom view of the sidewall shown in FIG. 64.

According to an exemplary embodiment, the male mating features include one or more protrusions 424 and a mating tab 426 extending from the base 410. In the illustrated exemplary embodiment, the mating tab 426 is positioned between two protrusions 424. The protrusions 424 have a substantially planar, trapezoidal outer surface elongated in the vertical direction and tapering from the bottom to the top. In an exemplary embodiment, the protrusions 424 taper from the outer surface towards the side of the base 410 as best shown in FIG. 62. The mating tab 426 has a substantially triangular cross-section, although one or more of the vertices may be curved. The mating tab 426 has an angled top surface extending from the base 410 and a bottom facing towards the bottom of the base 410.

According to an exemplary embodiment, the female mating features include one or more sockets 428 extending into the base 410 and a mating opening 430 extending into or through the second side of the base 410. In the illustrated exemplary embodiment, the mating opening 430 is positioned between two sockets 428. The sockets 428 have a substantially planar, trapezoidal opening elongated in the vertical direction and tapering from the bottom to the top. In an exemplary embodiment, the sockets 428 taper from a back wall to the opening, to form a mating relationship with the tapered protrusions 424. The mating opening 430 is a rectangular or square opening configured to receive the mating tab 426. Any size, shape, and configuration of male and female mating features may be used.

According to an exemplary embodiment, the base 410 includes a support connecting feature. For example, the base 410 includes a channel for attaching the base 410 to a DIN rail and a release mechanism 432. The release mechanism 432 includes a leg 434 and a pair of columns 436 extending from a portion of the base 410 and connecting to the leg 434. The leg 434 includes a slot 438 at a first end and a prong 440 at a second end.

The base 410 can be snap fit onto the DIN rail and the leg 434 may bend or flex to allow for the connection to the DIN rail. To release the base 410, a user can insert a tool, such as a flat head screwdriver, into the slot 438 and apply a force to pull the prong 440 away from the DIN rail. The leg 434 pivots about the columns 436 to move the prong 440 out of engagement with the DIN rail and release the base 410. A block 442 positioned between the columns 436 limits the movement of the columns to prevent over bending, breaking, or other damage to the columns 436. The user may alternatively apply a force by hand.

In an exemplary embodiment, the base 410 includes a first slot 444 and a second slot 446 positioned to receive a cover mounting feature. The base may also include one or more cavities in the top and bottom surfaces to reduce the amount of material used, and to enable effective molding of the base 410.

FIGS. 64-67 depict an exemplary embodiment of a sidewall 414. The sidewall 414 includes a first side having first sidewall mating features 448A and a second side having second sidewall mating features 448B. The first and second sidewall mating features 448A, 448B are configured to mate with the base mating features 422A, 422B. In an exemplary embodiment, the first sidewall mating features 448A are male mating features and the second sidewall mating features 448B are female mating features.

In an exemplary embodiment, the sidewall 414 includes a first and second flange 450 extending at least partially along a first and second edge, respectively. The first and second flanges 450 include an opening, for example a U-shaped opening that may be used to receive or connect to various styles of lids.

In an exemplary embodiment, the sidewall 414 includes first and second channels 452 for receiving a primary cover 418 and a tap cover 420. The lid also includes one or more lid mounting features 454 for attaching a variety of lids to the base 410 and sidewall 414. In an exemplary embodiment, the lid mounting features 454 include a protrusion having a first cylindrical portion extending from the sidewall and a knob or other enlarged section at the end of the cylindrical portion.

Figure 68:
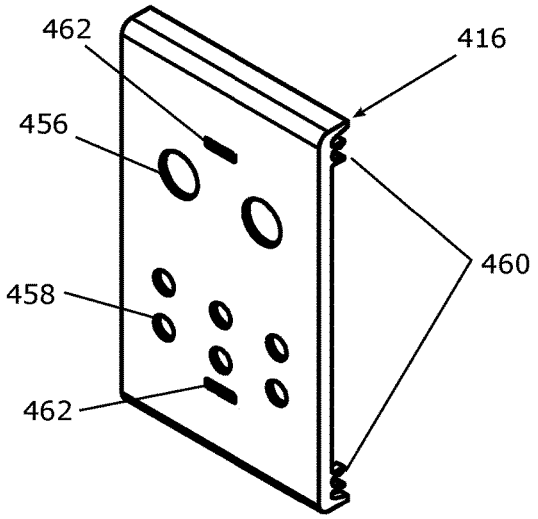
FIG. 68 is a top perspective view of an exemplary lid.
Figure 69:
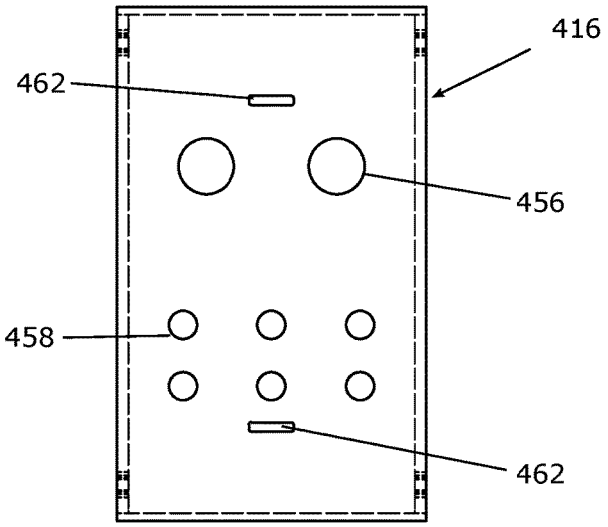
FIG. 69 is a top view of the lid shown in FIG. 68.
Figure 70:
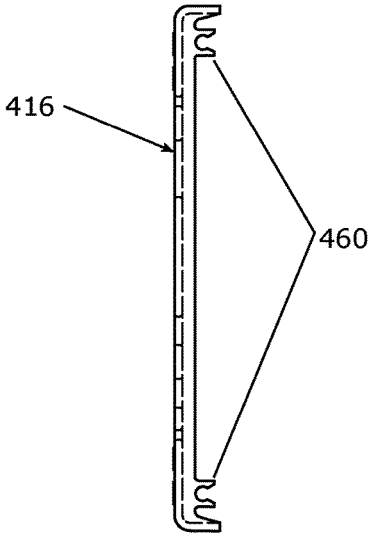
FIG. 70 is a right side view of the lid shown in FIG. 68.

FIGS. 68-70 depict an exemplary embodiment of a lid 416 having one or more primary apertures 456 and one or more tap apertures 458. The primary and tap apertures 456, 458 provide access to set screws in the conductor block 412. In various exemplary embodiments, the primary and tap apertures 456, 458 are finger-safe apertures sized to allow a tool or driver to be inserted through the lid 416 but prevent a user's finger from being placed through the lid 416 and in contact with the conductor block 412.

In an exemplary embodiment, the lid 416 includes lid connecting features 460 to connect the lid 416 to the sidewalls 414 by engaging the lid mounting features 454. In the illustrated exemplary embodiment, the lid connecting features 460 have a downwardly facing opening for mating with the lid mounting features 454. The openings may be substantially U-shaped or a half circle. The openings allow the lid connecting features 460 to snap-connect to the projections of the lid mounting features 454. The lid also includes a first and second slot 462 positioned to receive a portion of the primary and tap covers 418, 420. The exemplary distribution block 400 may utilize different lids than the one shown, including a non-finger safe style lid which may be similar to the lid 416 but pivotally connect to the sidewalls 414 and omit the primary and tap apertures 456, 458.

Figure 71:
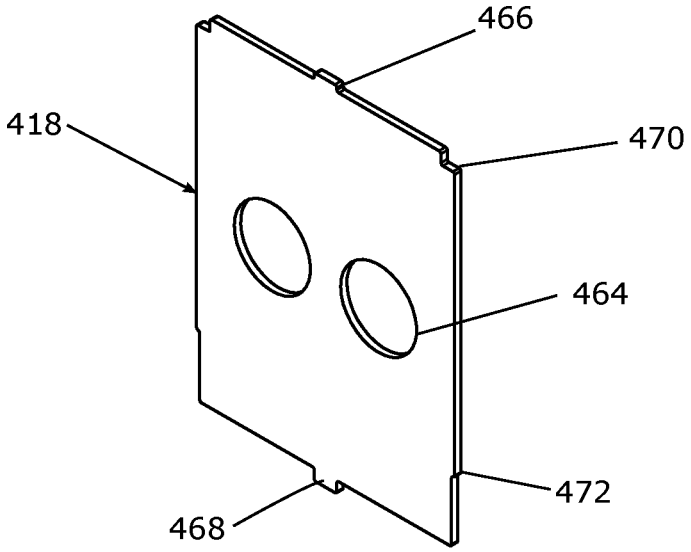
FIG. 71 is a top perspective view of an exemplary cover.
Figure 72:
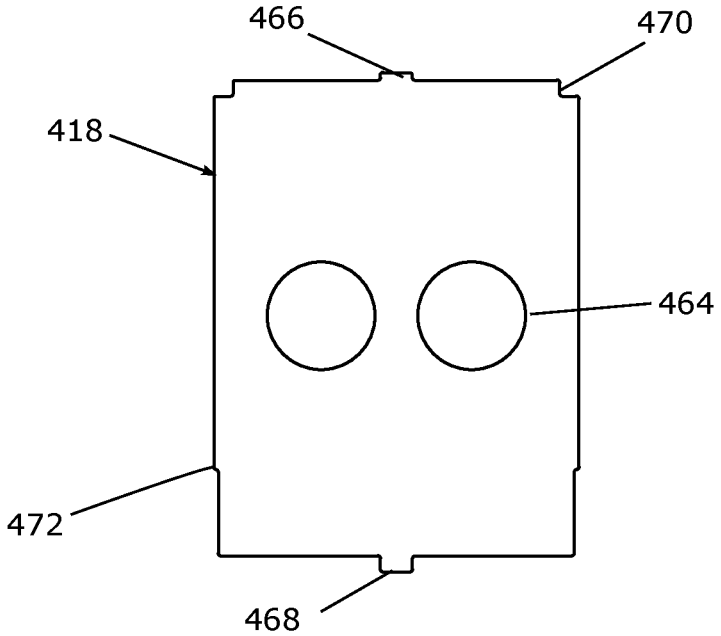
FIG. 72 is a front view of the cover shown in FIG. 71.

FIGS. 71 and 72 depict an exemplary primary cover 418. The primary cover 418 has one or more openings 464, for example two, to allow passage of conductors through the primary cover 418 to the conductor block 412. Two live primary conductors may be inserted into the distribution block 400 or the second opening 464 may be used to electrically power a tap conductor from the distribution block. The primary cover includes a top tab 466 and a bottom tab 468. The primary cover 418 is inserted into the channels 452 of the sidewall 414 and the bottom tab 468 is received in one of the first and second slots 444, 446 in the base 410. The top tab 466 is received in one of the slots 462 in the lid. The primary cover 418 includes a top pair of shoulders 470 for engaging or receiving a flange from the lid 416 and a bottom pair of shoulders 472 for engaging or receiving a flange or other thickened portion of the sidewall 414. In various exemplary embodiments, a tap cover has substantially the same configuration as the primary cover 418 with one or more tap conductor openings 474.

Various different exemplary embodiments are described herein and any feature or component of any embodiment may be combined or replaced with any other feature of component to form an exemplary distribution block.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present application, and are not intended to limit the structure of the exemplary embodiments of the present application to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. An electrical distribution block comprising:

a base;

a conductor block connected to the base;

a first sidewall connected to the base, the first sidewall including a first surface facing the conductor block and a second surface positioned opposite the first surface, wherein a male connection feature extends from the second surface away from the conductor block; and a second sidewall connected to the base, the second sidewall including a third surface facing the conductor block and a fourth surface positioned opposite the third surface, wherein a female connection feature extends into the fourth surface toward the conductor block.

2. The electrical distribution block of claim 1, wherein the male connection feature includes a pair of protrusions and the female connection feature includes a pair of sockets configured to mate with the protrusions.

3. The electrical distribution block of claim 2, wherein the protrusions have a substantially planar, trapezoidal outer surface elongated in the vertical direction and tapering from a bottom to a top of the protrusion.

4. The electrical distribution block of claim 2, wherein the protrusions taper from an outer surface towards the second surface.

5. The electrical distribution block of claim 2, wherein the sockets have a substantially planar, trapezoidal opening elongated in the vertical direction and tapering from a bottom to a top of the socket.

6. The electrical distribution block of claim 1, wherein the first sidewall includes a first lid mounting feature extending from the first surface and a second lid mounting feature extending from the second surface.

7. The electrical distribution block of claim 1, further comprising a second base connected to first sidewall, the second base having a second female connection feature configured to mate with male connection feature.

8. The electrical distribution block of claim 1, wherein the first sidewall and the second sidewall are removably connected to the base.

9. The electrical distribution block of claim 1, wherein the base includes a channel configured to releasably connect to a DIN rail.

10. An electrical distribution block comprising:

a base;

a conductor block connected to the base;

a first sidewall connected to the base, the first sidewall including a first surface facing the conductor block and a second surface positioned opposite the first surface, wherein a first lid mounting feature extends from the first surface and a second lid mounting feature extends from the second surface; and a second sidewall connected to the base, the second sidewall including a third surface facing the conductor block and a fourth surface positioned opposite the third surface, wherein a third lid mounting feature extends form the third surface and a fourth lid mounting feature extends from the fourth surface.

11. The electrical distribution block of claim 10, further comprising a lid connected to the first lid mounting feature and the third lid mounting feature.

12. The electrical distribution block of claim ii, wherein the lid includes a conductor aperture.

13. The electrical distribution block of claim 10, wherein each of the lid mounting features include a protrusion having a first cylindrical portion extending from the respective surface and a knob positioned at the end of the cylindrical portion.

14. The electrical distribution block of claim 10, wherein a male connection feature extends from the second surface away from the conductor block and a female connection feature extends into the fourth surface toward the conductor block.

15. The electrical distribution block of claim 14, wherein the male connection feature includes a pair of protrusions and the female connection feature includes a pair of sockets configured to mate with the protrusions.

16. The electrical distribution block of claim 10, wherein the base includes a channel configured to releasably connect to a DIN rail.

17. An electrical distribution block comprising:

a base having a lower portion, an upper portion, a first side portion extending from the top portion, and a second side portion extending from the top portion opposite the first side portion, wherein the bottom portion includes a channel configured to receive a DIN rail;

a first sidewall connected to the base, the first sidewall including a first surface facing the conductor block and a second surface positioned opposite the first surface;

a second sidewall connected to the base, the second sidewall including a third surface facing the conductor block and a fourth surface positioned opposite the third surface; and a conductor block connected to the upper portion of the base, wherein the conductor block includes a primary conductor receiving portion and a secondary conductor receiving portion.

18. The electrical distribution block of claim 17, wherein a release mechanism releasably secures the DIN rail in the channel.

19. The electrical distribution block of claim 17, wherein a male connection feature extends from the second surface away from the conductor block and a female connection feature extends into the fourth surface toward the conductor block.

20. The electrical distribution block of claim 17, wherein the first sidewall includes a first lid mounting feature extending from the first surface and a second lid mounting feature extending from the second surface.

* * * * *